US010137583B1

(12) United States Patent
Toone et al.

(10) Patent No.: US 10,137,583 B1
(45) Date of Patent: Nov. 27, 2018

(54) RAZOR DEVICE AND METHOD OF USING SAME

(71) Applicant: Irving Barber Company LLC, La Habra, CA (US)

(72) Inventors: Richard Mathew Toone, La Habra, CA (US); Christopher Toone, La Habra, CA (US); Nasser Pirshafiey, Thousand Oaks, CA (US); John Young, Whittier, CA (US)

(73) Assignee: IRVING BARBER COMPANY LLC, La Habra, CA (US)

( * ) Notice: Subject to any disclaimer, the term of this patent is extended or adjusted under 35 U.S.C. 154(b) by 309 days.

(21) Appl. No.: 14/814,751

(22) Filed: Jul. 31, 2015

Related U.S. Application Data

(60) Provisional application No. 62/032,527, filed on Aug. 2, 2014.

(51) Int. Cl.
*B26B 21/10* (2006.01)
*B26B 21/40* (2006.01)

(52) U.S. Cl.
CPC ..... *B26B 21/4037* (2013.01); *B26B 21/10* (2013.01)

(58) Field of Classification Search
CPC ..... B26B 21/10; B26B 21/4037
See application file for complete search history.

(56) References Cited

U.S. PATENT DOCUMENTS 842,927 A * 2/1907 Walter ..... B26B 21/10 30/54
901,537 A 10/1908 Koscherak
1,145,984 A 7/1915 Fuller
1,288,522 A 12/1918 Cowan
1,338,908 A 5/1920 Crawford
1,350,960 A * 8/1920 Evans ..... B26B 21/10 24/517
1,693,348 A 11/1928 Pollifrone
1,774,617 A * 9/1930 Temple ..... B26B 21/08 30/32
1,782,455 A * 11/1930 Baker ..... B26B 21/10 30/333
1,932,458 A * 10/1933 Hanson ..... B26B 21/10 30/330
2,479,788 A 8/1949 Stokes
2,707,830 A 5/1955 McColl
2,857,668 A * 10/1958 Galbraith ..... B26B 21/10 30/54
3,031,757 A 5/1962 Kramer
3,106,020 A 10/1963 Tape
3,308,533 A 3/1967 Holohan
3,383,763 A 5/1968 Strandfors
3,388,467 A 6/1968 Martin
(Continued)

*Primary Examiner* — Omar Flores Sanchez
(74) *Attorney, Agent, or Firm* — Proven Patents Law Firm; Kregg Koch

(57) ABSTRACT

A razor for supporting a razor blade comprising a blade support arm, a handle element, and a cover element couple-able with the blade support arm. The razor can removably support the razor blade between the blade support arm and the cover element. The blade support arm can have a recess formed therein, and the cover member can be coupled with the blade support arm adjacent to the recess. Additionally, the cover member can be rotatable relative to the blade support arm to allow easy removal and/or replacement of the blade.

37 Claims, 27 Drawing Sheets

(56) References Cited

U.S. PATENT DOCUMENTS

| | | | | |
|---|---|---|---|---|
| 3,728,788 | A | 4/1973 | Pearson | |
| 3,983,627 | A | 10/1976 | Montrasi | |
| 4,285,125 | A | 8/1981 | Chen | |
| 4,630,365 | A | 12/1986 | Imaizumi | |
| 4,709,475 | A * | 12/1987 | Phung | B26B 21/12 132/76.2 |
| 6,701,619 | B2 | 3/2004 | Haruyuki | |
| 6,722,039 | B2 | 4/2004 | Kitano | |
| 2013/0333221 | A1 | 12/2013 | Pineda | |

* cited by examiner

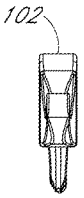
FIG. 18
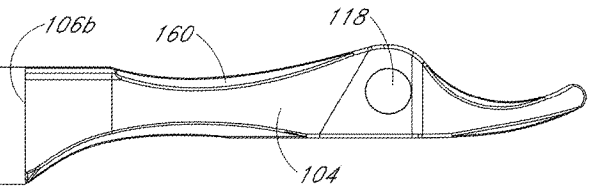
FIG. 13
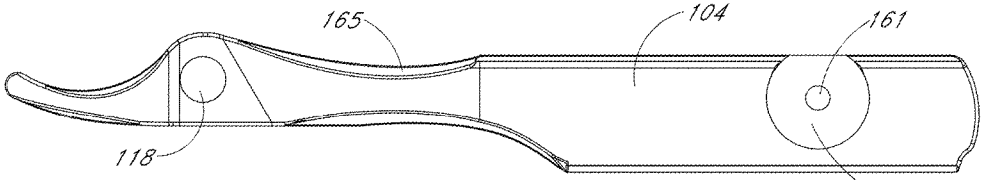
FIG. 14
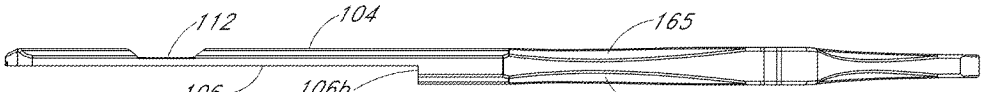
FIG. 15
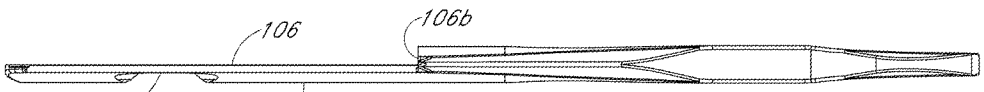
FIG. 16
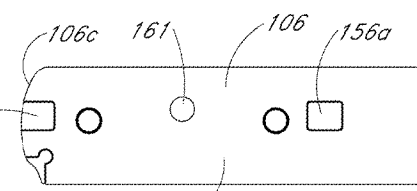
FIG. 17
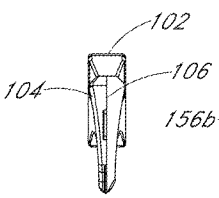

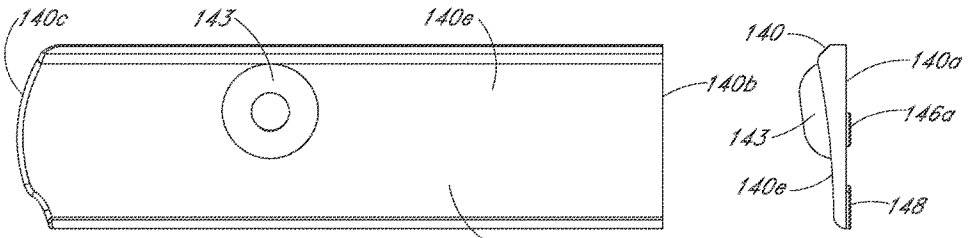
FIG. 26
FIG. 21
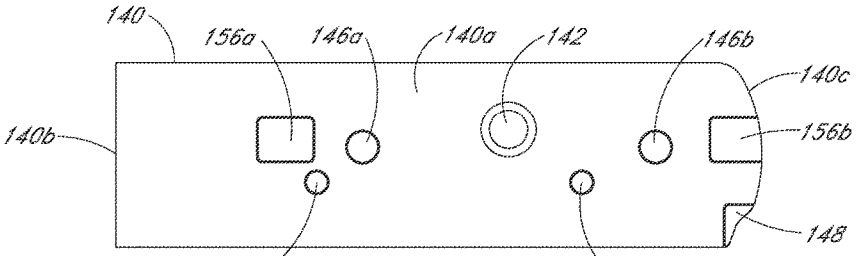
FIG. 22
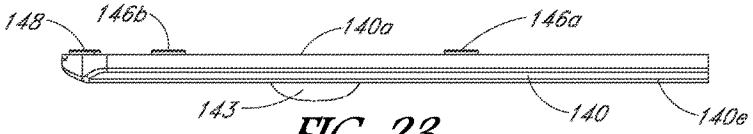
FIG. 23
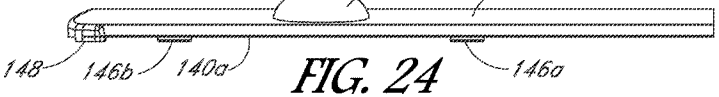
FIG. 24
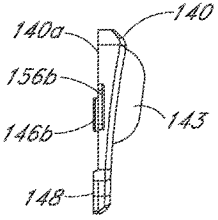
FIG. 25

400
410

408

412

404
406
414
402

RAZOR DEVICE AND METHOD OF USING SAME

CROSS-REFERENCE TO RELATED APPLICATIONS

This application claims the benefit of U.S. Provisional Patent Application No. 62/032,527, filed on Aug. 2, 2014, the entirety of which is hereby incorporated by reference and made a part of the present disclosure as if fully set forth herein.

BACKGROUND OF THE DISCLOSURE

Field of the Disclosure

The disclosure relates to shaving devices, in particular, straight razors and holders for exchangeable razor blades.

Description of the Related Art

Straight razor blades are commonly used in the barber industry for providing a close and accurate shape to customers. There is a need for developing a blade holder for exchangeable straight blades that permits a barber to quickly and easily exchange blades after use and provides the barber with a comfortable ergonomic grip so that the barber can perform the accurate shaving procedures that are required for barbers. Additionally, there is a need for such a device that is capable of holding multiple different straight blade types, including but not limited to double-edge blades, standard injector blades, and Feather type injector blades.

SUMMARY OF SOME EMBODIMENTS

Some embodiments disclosed herein relate to a razor device, which can be used to support one or more of a variety of exchangeable straight razor blades and can be configured to permit a user to easily and quickly change and discard the razor blades. Some embodiments are directed to a foldable razor that is capable of supporting one or more different straight razor blades.

In any embodiments disclosed herein, the handle for the blades can be foldable or non-foldable. For non-foldable handles, and additional blade cover or protective cover can be included with the handle to prevent inadvertent or accidental injuries that can occur from an exposed blade.

It should be noted that any of the features, components, or details of any of the arrangements or embodiments disclosed in this application, including those disclosed below, are interchangeably combinable with any other features, components, or details of any of the arrangements or embodiments disclosed herein to form new arrangements and embodiments.

The following arrangements describe some embodiments of the present disclosure.

A first arrangement of a razor device for supporting a razor blade, comprising a blade support member having a recess formed therein, a handle member coupled with the blade support member and rotatable relative to the blade support member, and a cover member coupleable with the blade support member. The razor blade can be removably supportable between the blade support arm and the cover member. Additionally, the cover member can be coupleable adjacent to the recess.

The razor device of the first arrangement, wherein the cover member has a perimeter shape that can be approximately the same as a perimeter shape of the recess.

The razor device of any one of the previous arrangements, wherein the fastener for the cover member can be removably coupleable with the blade support member using a screw type fastener.

The razor device of any one of the previous arrangements, wherein the fastener for the cover member can be removably coupleable with the blade support member using a screw type fastener that can be rotatable without a use of tools.

The razor device of any one of the previous arrangements, wherein the fastener for the cover member can be removably coupleable with the blade support member using a screw type fastener having a head portion that extends partially above a top surface of the cover member such that a user can loosen or tighten the fastener by moving the user's thumb or forefinger against the portion of the head portion of the fastener that extends partially above the top surface of the cover member.

The razor device of any one of the previous arrangements, wherein the fastener for the cover member can be removably coupleable with the blade support member using a screw type fastener having a head portion that extends partially above a top surface of the cover member such that a user can loosen or tighten the fastener by exerting a tangential force on the portion of the head portion of the fastener that extends partially above the top surface of the cover member.

The razor device of any one of the previous arrangements, wherein the razor device can be configured to support any one of a standard injector razor blade, a Feather razor blade, and a double-edge razor blade.

The razor device of any one of the previous arrangements, comprising one or more magnets supported by the cover member.

The razor device of any one of the previous arrangements, comprising a first protrusion and a second protrusion extending away from a first planar surface of the cover member in a direction that can be generally perpendicular to the first planar surface, wherein:

- the cover member can be configured to support a razor blade against the first planar surface;
- the first protrusion can be spaced apart from the second protrusion;
- the first and second protrusions limit a translation of the razor blade in at least a first direction along the first planar surface when the razor blade can be in contact with the first planar surface; and
- the first direction is defined as the direction that can be approximately perpendicular to a cutting edge of the razor blade that is supported in an operable position against the first planar surface and in contact with the first and second protrusions.

The razor device of any one of the previous arrangements, further comprising a third protrusion extending away from a first planar surface of the cover member in a direction that is generally perpendicular to the first planar surface, wherein:

- the third protrusion limits the translation of the razor blade in a second direction along the first planar surface when the razor blade is in contact with the first planar surface; and
- the second direction is defined as the direction that is approximately parallel to the cutting edge of the razor blade that is supported in an operable position against the first planar surface and in contact with the first and second protrusions.

The razor device of any one of the previous arrangements, comprising a first protrusion and a second protrusion extending away from a first planar surface of the cover member in a direction that is generally perpendicular to the first planar surface, wherein:

the cover member can be configured to support a razor blade against the first planar surface;

the first planar surface is a surface of the blade support member against which a planar surface of the razor blade is positioned when the razor blade is supported by the blade support member in an operable position; and the first and second protrusions are configured to provide a stop surface for at least one of a double-edge razor blade that has been split in half, a standard injector blade, and a Feather injector blade so that a distance that the double-edge razor blade that has been split in half, the standard injector blade, and the Feather injector blade extends away from an edge of the blade support member in a direction that is perpendicular to a cutting edge of the razor blade is approximately the same for each of the double-edge razor blade that has been split in half, the standard injector blade, and the Feather injector blade.

The razor device of any one of the previous arrangements, wherein the blade support member has one or more beveled edges.

The razor device of any one of the previous arrangements, comprising two or more recesses formed in the blade support member configured to receive the bent edges of a double-edge razor blade that has been split in half, the two or more recesses extending through a first planar surface of the blade support member, the first planar surface being a surface of the blade support member against which a planar surface of the razor blade is positioned when the razor blade is supported by the blade support member in an operable position.

The razor device of any one of the previous arrangements, wherein the blade support member has a curved depression formed therein between a first end of the blade support member and the recess, the curved depression configured to improve a grip and a control of the razor device when the user applies his or her thumb against the depression.

An arrangement of a razor device for supporting a razor blade, comprising a blade support member, and a cover member coupleable with the blade support member, the cover member being rotatable relative to the blade support member between a first position in which the cover member supports the razor blade in a usable position and a second position in which the razor blade is removable from the razor device. In some embodiments, the razor can be configured to removably support the razor blade between the blade support arm and the cover member.

The razor device of any one of the previous arrangements, comprising a recess formed in the blade support member.

The razor device of any one of the previous arrangements, comprising a fastener to removably couple the cover member to the blade member.

The razor device of any one of the previous arrangements, comprising a fastener to removably couple the cover member to the blade member, the fastener being located relative to the cover member and the blade support member at a position that approximately aligns with a middle of the razor blade that is supportable by the razor device.

The razor device of any one of the previous arrangements, comprising a handle member coupleable with the blade support member and rotatable relative to the blade support member.

The razor device of any one of the previous arrangements, wherein the cover member has a perimeter shape that can be approximately the same as a perimeter shape of the recess.

The razor device of any one of the previous arrangements, wherein the fastener for the cover member can be removably coupleable with the blade support member using a screw type fastener.

The razor device of any one of the previous arrangements, wherein the fastener for the cover member can be removably coupleable with the blade support member using a screw type fastener that can be rotatable without a use of tools.

The razor device of any one of the previous arrangements, wherein the fastener for the cover member can be removably coupleable with the blade support member using a screw type fastener having a head portion that extends partially above a top surface of the cover member such that a user can loosen or tighten the fastener by moving the user's thumb or forefinger against the portion of the head portion of the fastener that extends partially above the top surface of the cover member.

The razor device of any one of the previous arrangements, wherein the fastener for the cover member can be removably coupleable with the blade support member using a screw type fastener having a head portion that extends partially above a top surface of the cover member such that a user can loosen or tighten the fastener by exerting a tangential force on the portion of the head portion of the fastener that extends partially above the top surface of the cover member.

The razor device of any one of the previous arrangements, wherein the razor device can be configured to support any one of a standard injector razor blade, a Feather razor blade, and a double-edge razor blade.

The razor device of any one of the previous arrangements, comprising one or more magnets supported by the cover member.

The razor device of any one of the previous arrangements, comprising a first protrusion and a second protrusion extending away from a first planar surface of the cover member in a direction that can be generally perpendicular to the first planar surface, wherein:

the cover member can be configured to support a razor blade against the first planar surface;

the first protrusion can be spaced apart from the second protrusion;

the first and second protrusions limit a translation of the razor blade in at least a first direction along the first planar surface when the razor blade can be in contact with the first planar surface; and the first direction is defined as the direction that can be approximately perpendicular to a cutting edge of the razor blade that is supported in an operable position against the first planar surface and in contact with the first and second protrusions.

The razor device of any one of the previous arrangements, further comprising a third protrusion extending away from a first planar surface of the cover member in a direction that is generally perpendicular to the first planar surface, wherein:

the third protrusion limits the translation of the razor blade in a second direction along the first planar surface when the razor blade is in contact with the first planar surface; and the second direction is defined as the direction that is approximately parallel to the cutting edge of the razor blade that is supported in an operable position against the first planar surface and in contact with the first and second protrusions.

The razor device of any one of the previous arrangements, comprising a first protrusion and a second protrusion extending away from a first planar surface of the cover member in a direction that is generally perpendicular to the first planar surface, wherein:

the cover member can be configured to support a razor blade against the first planar surface;

the first planar surface is a surface of the blade support member against which a planar surface of the razor blade is positioned when the razor blade is supported by the blade support member in an operable position; and the first and second protrusions are configured to provide a stop surface for at least one of a double-edge razor blade that has been split in half, a standard injector blade, and a Feather injector blade so that a distance that the double-edge razor blade that has been split in half, the standard injector blade, and the Feather injector blade extends away from an edge of the blade support member in a direction that is perpendicular to a cutting edge of the razor blade is approximately the same for each of the double-edge razor blade that has been split in half, the standard injector blade, and the Feather injector blade.

The razor device of any one of the previous arrangements, wherein the blade support member has one or more beveled edges.

The razor device of any one of the previous arrangements, comprising two or more recesses formed in the blade support member configured to receive the bent edges of a double-edge razor blade that has been split in half, the two or more recesses extending through a first planar surface of the blade support member, the first planar surface being a surface of the blade support member against which a planar surface of the razor blade is positioned when the razor blade is supported by the blade support member in an operable position.

The razor device of any one of the previous arrangements, wherein the blade support member has a curved depression formed therein between a first end of the blade support member and the recess, the curved depression configured to improve a grip and a control of the razor device when the user applies his or her thumb against the depression.

A method of changing a razor blade in a razor, comprising:

loosening a first fastener coupled with a blade support member;

rotating a cover member from a first position to a second position relative to the blade support member;

removing the razor blade from razor;

inserting a new razor blade between the cover member and the blade support member;

rotating the cover member to the first position; and tightening the first fastener.

The razor blade of this method can have any of the features, components, sizes, materials, or other details of any of the razor blade device embodiments or arrangements disclosed herein.

BRIEF DESCRIPTION OF THE DRAWINGS

Embodiments of the present disclosure will now be described hereinafter, by way of example only, with reference to the accompanying drawings in which:

FIG. 13 is a first side view of the embodiment of the blade support member shown in FIG. 1.

FIG. 14 is a second side view of the embodiment of the blade support member shown in FIG. 1.

FIG. 15 is a top view of the embodiment of the blade support member shown in FIG. 1.

FIG. 16 is a bottom view of the embodiment of the blade support member shown in FIG. 1.

FIG. 17 is a first end view of the embodiment of the blade support member shown in FIG. 1.

FIG. 18 is a second end view of the embodiment of the blade support member shown in FIG. 1.

FIG. 21 is a first side view of the embodiment of the cover member shown in FIG. 1.

FIG. 22 is a second side view of the embodiment of the cover member shown in FIG. 1.

FIG. 23 is a top view of the embodiment of the cover member shown in FIG. 1.

FIG. 24 is a bottom view of the embodiment of the cover member shown in FIG. 1.

FIG. 25 is a first end view of the embodiment of the cover member shown in FIG. 1.

FIG. 26 is a second end view of the embodiment of the cover member shown in FIG. 1.

DETAILED DESCRIPTION OF SOME EMBODIMENTS

Figure 1:
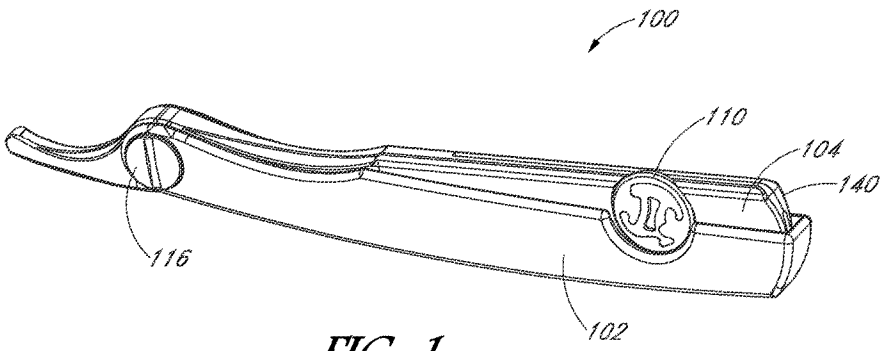
FIG. 1 shows an embodiment of a razor for supporting removable blades, the razor being in a closed state or position.
Figure 2:
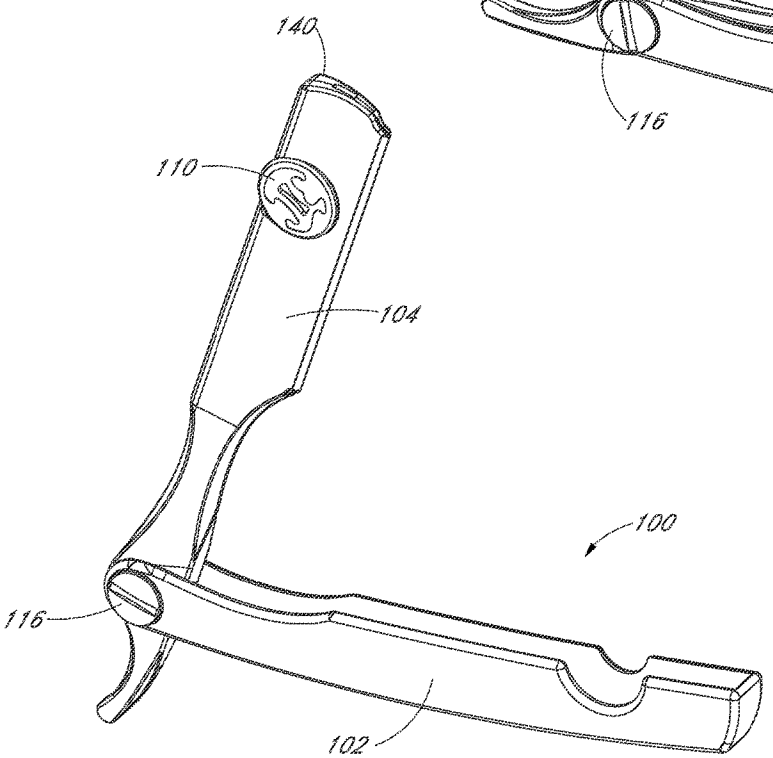
FIG. 2 shows the embodiment of the razor shown in FIG. 1 in a partially open state or position.
Figure 8:
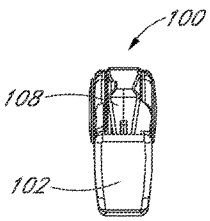
FIG. 8 is a second end view of the embodiment of the razor shown in FIG. 1.
Figure 3:
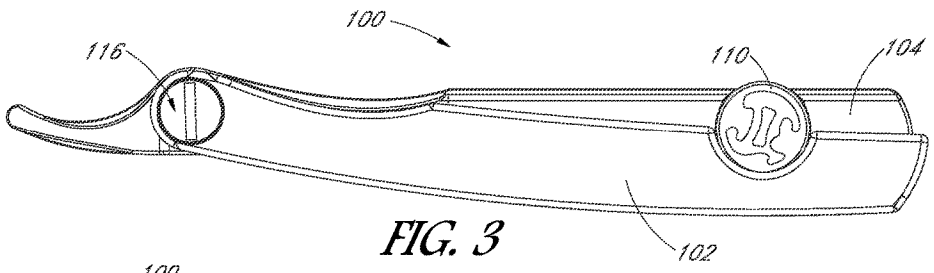
FIG. 3 is a first side view of the embodiment of the razor shown in FIG. 1.
Figure 4:
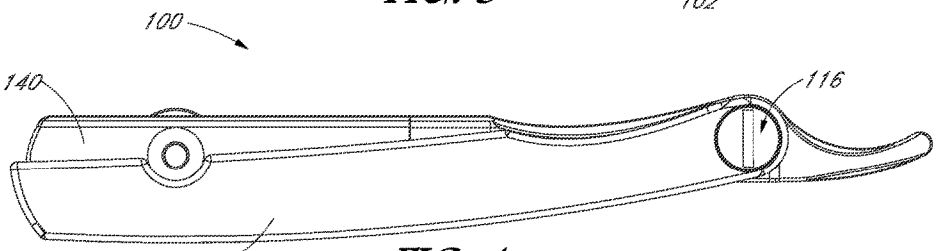
FIG. 4 is a second side view of the embodiment of the razor shown in FIG. 1.
Figure 5:
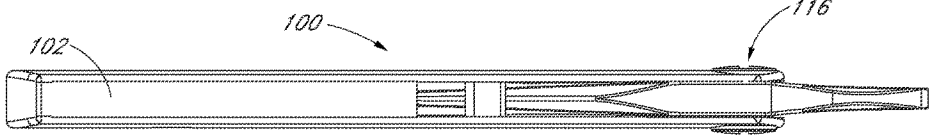
FIG. 5 is a top view of the embodiment of the razor shown in FIG. 1.
Figure 6:
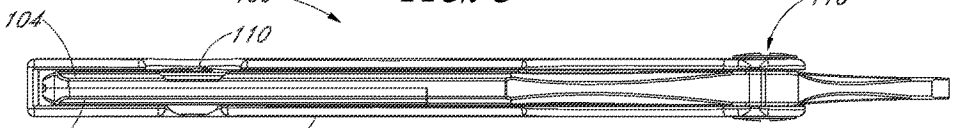
FIG. 6 is a bottom view of the embodiment of the razor shown in FIG. 1.
Figure 7:
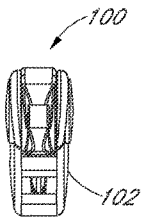
FIG. 7 is a first end view of the embodiment of the razor shown in FIG. 1.

Embodiments disclosed herein relate to novel straight razor shaving devices and methods of using same. FIG. 1 illustrates an embodiment of a razor 100 that can be used for supporting any of a variety of exchangeable blades. The razor 100 can have a handle member 102 (also referred to as a handle element or portion), a blade support member 104 (also referred to herein as a blade support element or portion or blade support) that can be attached to the handle member 102, and a blade cover member 140 (also referred to as a cover plate or blade cover) coupleable with the blade support member 104.

In any embodiments disclosed here, the blade cover member 140 can be coupleable with the blade support member 104 using any suitable techniques and/or fasteners. In any embodiments, the blade cover member 140 can be removably couplable with the support member 104. With reference to the Figures, any embodiments of the blade support member 104 can have a recess 106 sized and shaped such that a perimeter of the recess 106 substantially matches a size and shape of a profile or perimeter of the blade cover member 140. In any embodiments disclosed herein, the recess (including, but not limited to, the recess 106) can extend from a top of the blade support member 104 to a bottom of the blade support member 106. Additionally, in any embodiments, the recess can extend from an end of the blade support member 106 toward the opening 118 a distance that is approximately the same as, or slightly greater than, or between approximately 10% greater to approximately 20% greater than, or between approximately 20% greater than to approximately 30% greater or more than, a width of a razor blade supportable by the razor device. As mentioned above, without limitation, any razor device disclosed herein can support a double-edge razor blade that has been split in half, a standard injector blade, a Feather injector blade, and any other similar razor blade or other single use or other razor blade commonly used for straight razor shaving.

In any embodiments disclosed herein, the cover member can have approximately a same perimeter shape and approximately a same width and length as the recess of the razor device that the cover member is coupled against. Additionally, in any embodiments disclosed herein, the cover member can have a different shape than the recess and/or have a different width and/or length as the recess of the razor device that the cover member is coupled against. The cover member overlap one or more edges of the recess and abut against the support member.

The cover member can be coupled with the blade support member such that the cover member fits within or adjacent to the recess 106. For example and without limitation, with reference to FIGS. 9 and 10, any embodiments of the razor disclosed herein can have a blade support member 104 having a recess 106 having a first surface 106*a*, a first edge 106*b*, and a second edge 106*c*. Any embodiments of the cover member 140 can have a first surface 140*a*, a first edge 140*b*, and a second edge 140*c*. The first edge 106*b* and second edge 106*c* of the recess can substantially match the first edge 140*b* and second edge 140*c* of the cover member 140 so that, when the cover member 140 is removably coupled to the support member 104, the cover member 140 substantially fits within the recess 106 and matches a perimeter shape of the recess 106.

In some embodiments, the first edge 106*b* of the recess and the first edge 140*b* of the cover member can be substantially straight or planar. In some embodiments, the second edge 106*c* of the recess 106 and the second edge 140*c* of the cover member 140 can be generally curved. Additionally, in any embodiments disclosed herein, the cover member 140 can have a length that is approximately 20% greater than a length of a razor blade to be supported between the cover member 140 and the support member 104, or from approximately 10% to approximately 20%, or from approximately 20% to approximately 30% greater than a length of a razor blade to be supported between the cover member 140 and the support member 104. As used herein, the terms approximately and substantially are meant to designate a dimension or value that is within 10% or less of the stated dimension or value.

In any embodiments disclosed herein, the blade cover 140 can be removably coupled with the support member 104 using the threaded fastener 110. Coupling the cover member 140 with the support member 104 can exert a compression force on a razor blade positioned between the first surface 106*a* of the recess 106 and the first surface 140*a* of the cover member 140 that is sufficient to hold the razor blade in the desired position relative to the support member 104 and the cover member 140. In any embodiments disclosed herein, a frictional force from the first surface 106*a* of the recess 106 and/or the first surface 140*a* of the cover member 140 can be used to hold the razor blade in the desired position. Additionally, in any embodiments disclosed herein, a magnetic or adhesive force applied to the razor blade from magnets or adhesive supported by one or both of the support member 104 and/or the cover member 140 can be used to hold the razor blade in the desired position.

In any embodiments disclosed herein, the threaded fastener can be a screw type fastener. The threaded fastener 110 can, for example and without limitation, be a thumbscrew wherein a portion of a head of the fastener 110 can extend above a top surface or perimeter of the support member 104 such that a user of the razor device 100 can easily rotate the fastener 110 by translating the user's thumb or finger or other object along the portion of the fastener 110 (for example, a portion of the head of the fastener) that extends above the perimeter or a top surface of the support member 104. In this configuration, the user can easily tighten or loosen the fastener 110 relative to the blade cover 140 using the fastener 110. An edge surface or main surface of the head of the fastener 110 can have ridges, notches, bumps, channels, protrusions, pits, gripping elements, or other similar features or texture to increase a friction or grippiness of the edge or main surface of the head of the fastener to make it easier for a user to loosen or tighten the fastener with, for example and without limitation, a user's thumb or forefinger, during use.

In any embodiments disclosed herein, the blade cover 140 can have a threaded opening or recess 142 therein configured to receive a threaded end portion of the fastener 110. The threaded opening 142 can be formed through a thickness of the cover member 140 and can extend into a boss or protrusion 144 extending away from a back surface 140*d* of the cover member.

In any embodiments disclosed herein, the opening or recess (such as the opening or recess 142), can be located at any desired position along the length of the cover member 140. For example, in any embodiments, the opening can be positioned near the midpoint of the cover member, or between a midpoint and a point that is approximately ⅔ along a length of the cover member from a first end (such as first end 140*b*) of the cover member toward a second end (such as second end 140*c*) of the cover member. In any embodiments disclosed herein, the recess can be at a position that is approximately 55% to approximately 65% along the length of the cover member 140. Additionally, in any embodiments disclosed herein, as shown for example in FIGS. 35 and 36, the recess 142 and hence the fastener 110 can be positioned on the razor 100 at a position that is approximately located at the middle of a length of the razor blade that is supported within the razor 100.

With reference to FIGS. 19-26, in any embodiments of the cover member 140 disclosed herein, the cover member can have a protrusion 143 substantially aligned with the opening or recess 142. The protrusion 143 can be configured to provide additional material and/or thickness for the recess 142, to increase the depth of the opening or recess 142 without increasing the overall thickness of the cover member 140. The protrusion 143 can have a thickness or height that is approximately equal to a thickness of the cover member 140 is between approximately 75% and approximately 90% the thickness of the cover member 140.

Additionally, as will be described in greater detail below, the fastener 110 can be configured such that, as a user loosens the fastener 110 relative to the blade cover 140, the fastener 110 will merely rotate and not translate relative to the support member 104, such that the fastener 110 is always or is at least biased to substantially remain in a fixed translational position in the axial direction relative to the support member 104, or to remain substantially connected to the support member 104 so that the fastener does not get lost or removed from the body portion 106. For example, without limitation, in some embodiments, a base portion of the threaded shaft or threaded portion of the fastener 110 can have a smaller diameter than a threaded portion of the shaft and be unthreaded.

Figure 9:
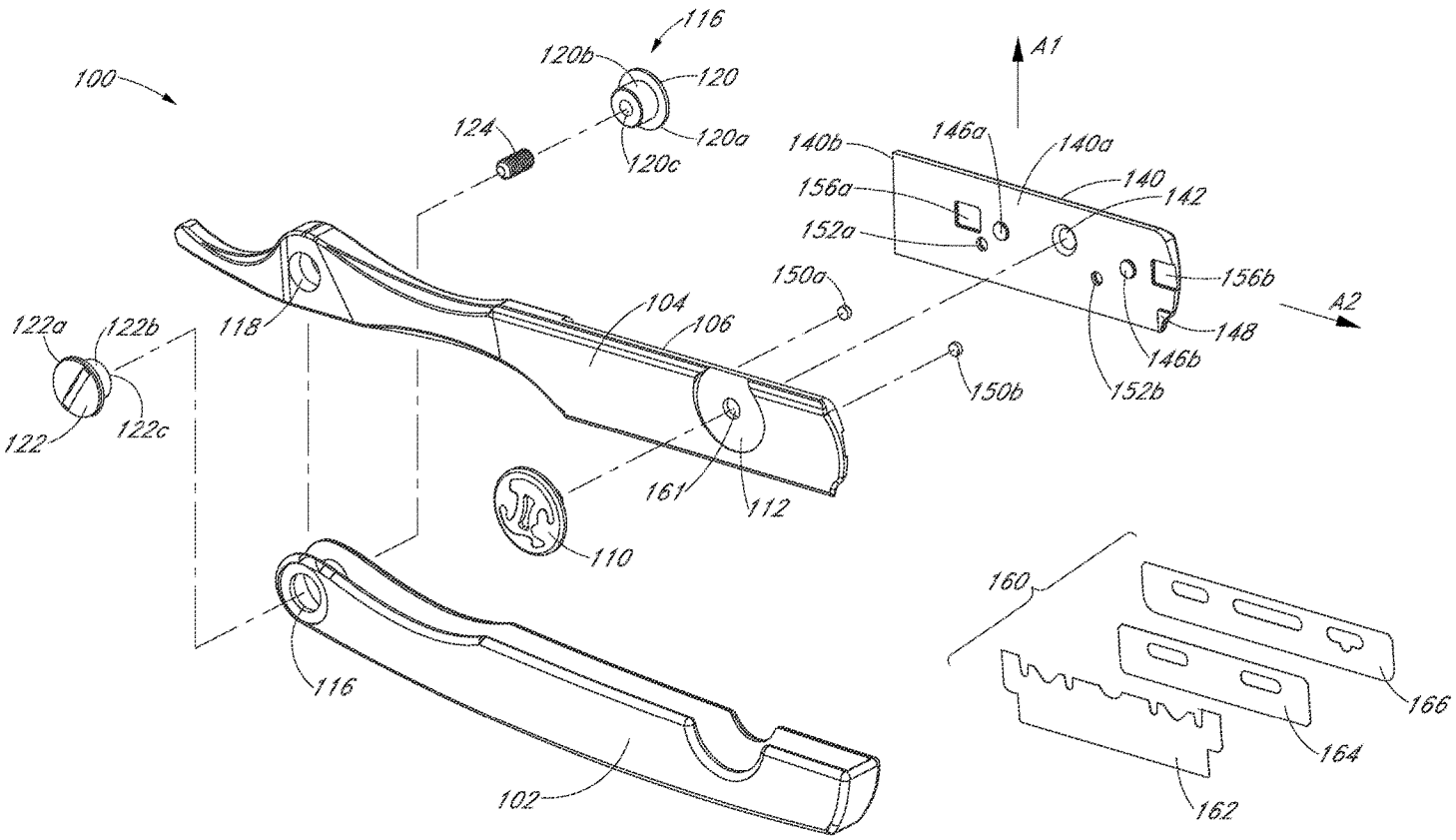
FIG. 9 is a first exploded view of the embodiment of the razor shown in FIG. 1.

With reference to FIG. 9, the support member 104 can be coupled with the handle element 102 using any suitable techniques or fasteners, such as without limitation the fastener assembly 116. In any embodiments disclosed herein, without limitation, the fastener assembly 116 can be configured to pass through one or more openings in the handle member 102 and one or more openings 118 in the blade support member 104 and provide an axle or shaft about which one or both of the cover member 102 and the blade support member 104 can rotate. In some embodiments, as illustrated in FIG. 9, the fastener 116 can comprise a first fastener element 120, a second fastener element 122, and a threaded member 124 configured to couple the first fastener element 120 with the second fastener element 122.

In any embodiments disclosed herein, the first fastener element 120 can have a flange portion 120*a*, a body portion 120*b*, and a recess or opening 120*c* that extends axially through all or a portion of the body portion 120*b*. Similarly, the second fastener element 122 can have a flange portion 122*a*, a body portion 122*b* and a recess or opening 122*c* that extends axially through all or a portion of the body portion 122*b*. In the embodiment illustrated in FIG. 9, the openings 120*c* and 122*c* extend only partially through the body portions of the respective fastener elements. Additionally, the body portions 120*b*, 122*b* can have a cylindrical surface sized to be slightly smaller than one or both of the openings 116, 118 and configured to permit the cover member 102 and/or the blade support member 104 to easily rotate about the body portions 120*b*, 122*b*. Additionally, in some embodiments, the fastener 116 can also include a threaded member 124 that can threadedly engage threaded recesses 120*c*, 122*c* so as to couple the first fastener element 120 with the second fastener element 122. Alternatively, the fastener member 116 can be configured such that either the first fastener element 124 the second fastener element 122 can have a threaded shaft extending axially from the body portion thereof (so as to be formed integrally or monolithically with the body portion), configured to engage a threaded recess in the other of the first fastener element and the second fastener element. Thread lock or other similar features or substances can be used to prevent the inadvertent loosening of any of the fasteners disclosed herein.

Any of the embodiments of the razor device disclosed herein, such as, without limitation, the razor device 100, can be configured to work with any of a variety of razor blades available on the market. For example and without limitation, any of the razor device embodiments disclosed herein can be configured to receive and support any of the three razor blades shown in FIG. 9, which include a double-edge razor blade 162 that has been split in half (as shown), a standard injector blade 164 (also referred to as a mini shaper blade), and a Feather injector blade 166 (also referred to as a Feather "Artist Club" Blade or Kai "Captain" blade). Additionally, any embodiments of the razor device 100 or any of the razor device embodiments disclosed herein can be configured to support an entire double-edge razor blade in its intact, double-edge configuration or any other suitable or available blade. For example, a height of the body member and/or the cover member can be increased so as to cover one of the two edges of the double-edge razor blade, thereby permitting a user to simply remove and rotate the double-edge razor blade to change the side of the double-edge razor blade that is exposed and usable for shaving or trimming.

FIGS. 9, 10, and 35-40 illustrate a double-sided injector blade 162 (broken in half), a standard injector blade 164, and a Feather injector blade 166 supported against the first surface 140*a* of the cover member 140. With reference to FIGS. 9, 10, and 35-40, in any embodiments disclosed herein, the blade cover member 140 can have a threaded opening 142 extending partially or fully through the cover member 140, configured to receive a threaded portion of the fastener 110. An opening 161 can be formed through the blade support member 104 to permit the fastener 110 to pass through the support member 104 and engage the opening 142 in the cover member 140. In any embodiments disclosed herein, the fastener 110 can be a threaded fastener having threads thereon that thread into the opening 142, which can have internal threads. By tightening the fastener after a razor blade has been positioned between the first surface 140*a* of the cover member 140 and the first surface 106*a* of the recess 106 formed in the support member 104, the razor blade can be tightly secured between the blade support member 104 and the cover member 140. To remove the blade, the user can quickly loosen the fastener 110 to remove the cover member 140 from the coupled position with the support member 104 and then simply remove the razor blade.

Additionally, in any embodiments disclosed herein, the blade cover member 140 can also have one or more stops 146, which can be posts or bosses extending from a first surface 140*a* (which can be generally planar). For example and without limitation, the cover member 140 can have a first stop element 146*a* and a second stop element 146*b* extending from the first surface 140*a* of the cover member 140. The stop elements 146 can be sized and positioned to provide a limit or a stop to limit a movement or translation of the razor blade to be supported against the cover member 140, thereby permitting a more accurate placement of the blades during installation of the blades and also preventing the movement of the blades in the direction of the stops during use, if the blade is positioned adjacent to the stops. For example, for the configuration illustrated FIG. 9, when a razor blade is positioned such that a planar surface of the razor blade is adjacent or abutting against to the surface 140*a* of the cover member 140, the stop elements 146 can limit or prevent the movement of the razor blade in the direction represented by arrow A1 shown in FIG. 9. In this configuration, the alignment posts or stops 146 can thereby allow for the accurate and consistent positioning of the razor blade relative to the cover member 140 and hence relative to the support member 104 so that a user of the razor blade device 100 is able to accurately and safely perform cutting operations using the razor device 100, knowing that the razor blade is supported within the support member 104 at or nearly at the same position every time a razor blade is installed in the razor 100. In any embodiments disclosed herein, any of the protrusions can have a Additionally, in any embodiments disclosed herein, the razor device can be configured such that any of the three types of blades that can be supported by the razor device, or any other similar or suitable types of blades, can be uniformly supported by the razor device. By uniformly supported, it is meant that, regardless of the razor blade type, the razor device (including, but not limited to, device 100 or 200 below) can be sized and configured such that the length that the blade extends away from the blade support member 104, the cover member 140, or other component or feature of the razor device is approximately the same. Ensuring that the exposed length of the blade (i.e., the distance of the blade extending away from the razor device) can provide for greater consistency and accuracy to the user of the razor device. For example, the stop elements 146 can be sized and configured to ensure that the length of the exposed portion of the blade is consistent from one blade to the next that is supported by the razor device, regardless of the type of blade.

Figure 10:
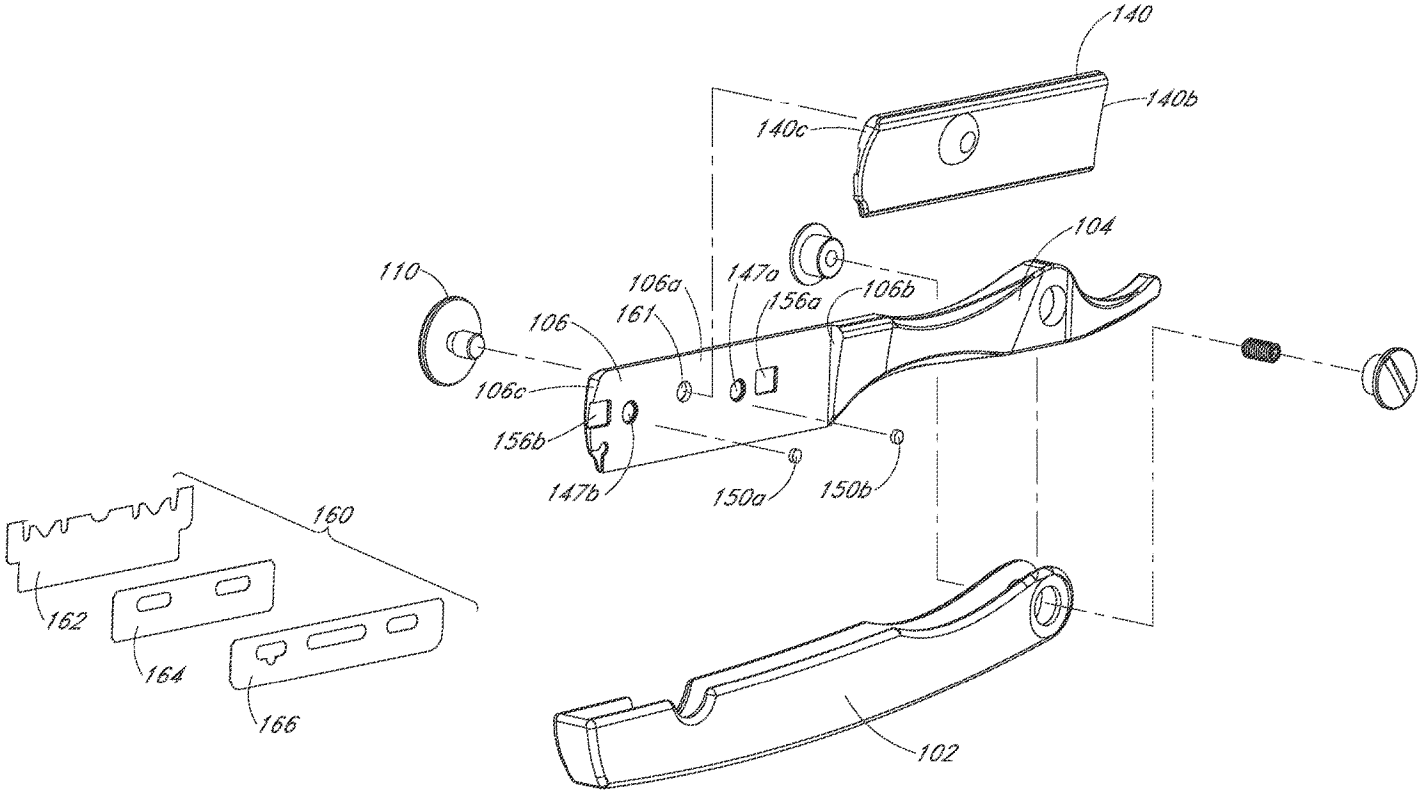
FIG. 10 is a second exploded view of the embodiment of the razor shown in FIG. 1.
Figure 35:
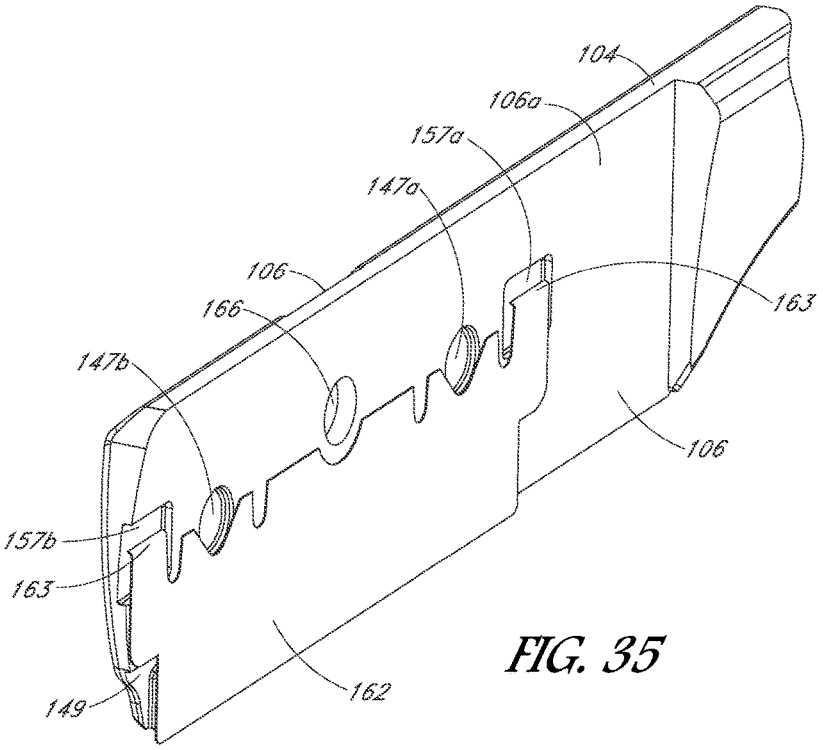
FIG. 35 is an isometric view of the embodiment of the blade support member shown in FIG. 1, shown supporting an exemplifying razor blade of a first type.

Additionally, as shown in FIGS. 10 and 35, the support member 104 can have one or more recesses 147 (such as recesses 147*a* and 147*b*) formed in the recess 106 and sized and positioned to permit the stop elements 146 to extend therein, thereby permitting the cover member 140 and the support member 104 to couple completely together and thereby compress the razor blade therebetween. The stop elements 146 and the recesses 147 can also assist in the accurate alignment of the cover member relative to the support member in any embodiments disclosed herein. Any of the stop members, protrusions, bosses, or recesses, can have angled and/or curved surfaces to facilitate the engagement of such features with the complementary features on the adjoining parts or components.

Figure 39:
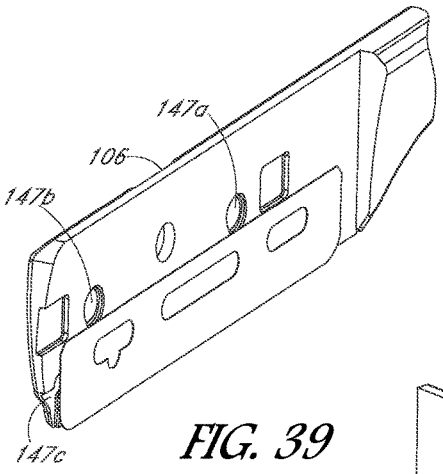
FIG. 39 is an isometric view of the embodiment of the blade support member shown in FIG. 1, shown supporting an exemplifying razor blade of a third type.
Figure 40:
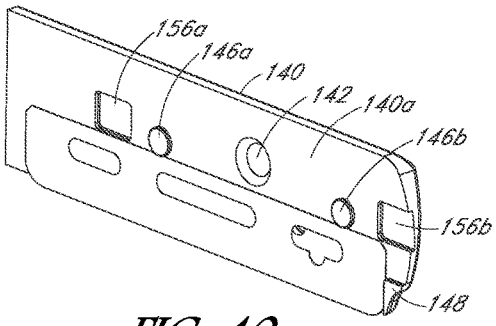
FIG. 40 is an isometric view of the embodiment of the cover member shown in FIG. 1, shown supporting an exemplifying razor blade of a third type.
Figure 41:
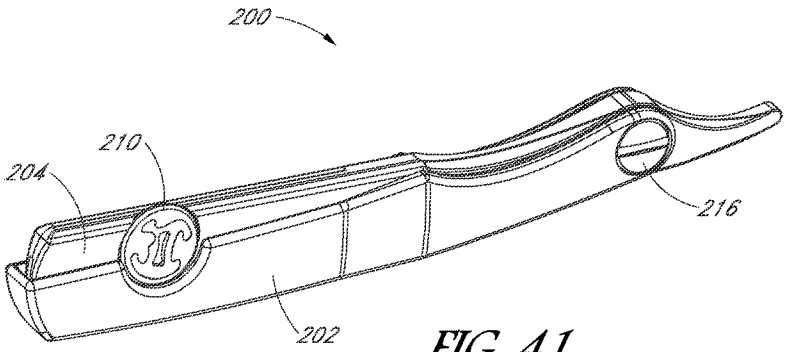
FIG. 41 shows another embodiment of a razor for supporting removable blades, the razor being in a closed state or position.

Similarly, in any embodiments disclosed herein, the cover member 140 can have a third stop element 148 (also referred to as a lengthwise stop) extending from the first surface 140*a* of the cover member 140. The stop element 148 can be sized and positioned to provide a limit or a stop to limit a movement or translation of the razor blade to be supported against the cover member 140 in the direction represented by Arrow A2 shown in FIG. 9. For example, for the configuration illustrated FIG. 9, when a razor blade is positioned such that a planar surface of the razor blade is adjacent or abutting against to the surface 140*a* of the cover member 140, a user can slide the razor blade in the direction represented by arrow A2 until the razor blade contacts the third stop element 148, thereby consistently positioning an end of the razor blade relative to the cover member 140 and, hence, the support member 104, regardless of the length of the razor blade. In this configuration, the end portion of the razor blade will always be positioned at the same proximity to or distance from the end of the cover member 140 and the support member 104 so that a user of the razor device 100 will be permitted to accurately and safely perform cutting operations with the razor device 100 regardless of the size of the razor blade that is supported within the razor device 100. FIGS. 39-41 illustrates three types of blades that have been positioned against the stop elements 146, 148 as described above.

Figure 36:
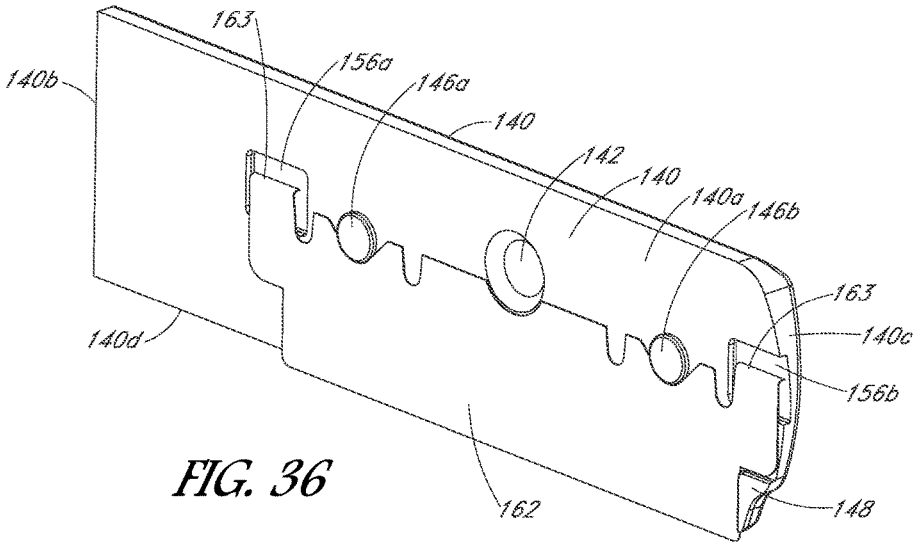
FIG. 36 is an isometric view of the embodiment of the cover member shown in FIG. 1, shown supporting an exemplifying razor blade of a first type.
Figure 37:
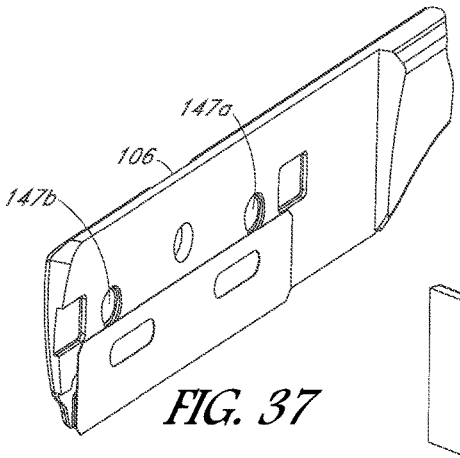
FIG. 37 is an isometric view of the embodiment of the blade support member shown in FIG. 1, shown supporting an exemplifying razor blade of a second type.
Figure 38:
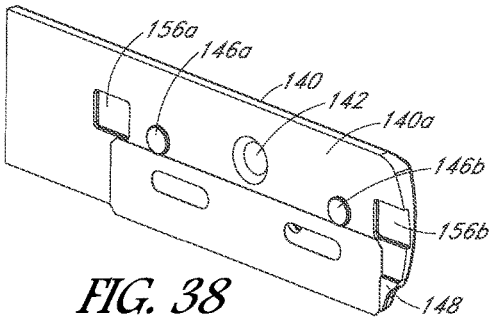
FIG. 38 is an isometric view of the embodiment of the cover member shown in FIG. 1, shown supporting an exemplifying razor blade of a second type.

As shown, the third stop element 148 can be positioned near or adjacent to the second end 140*c* of the cover member 140 and/or at or adjacent to a bottom edge 140*d* of the cover member 140. As shown in FIGS. 35-36, a complementary recess 149 can be formed in the support member 104, being sized and configured such that the third stop element 148 can extend into the recess 149.

Any of the stops or protrusions 146, 148 can extend away from this first surface 140*a* to a height or thickness that is approximately equal to an average thickness of any razor blade that can be supported by the razor 100. For example, the protrusions 146, 148 can have a height of approximately 0.005 in to approximately 0.025 in. Additionally, in any embodiments disclosed herein, the height of any of the protrusions can be from approximately 0.010 in to approximately 0.050 in or more, or up to approximately 0.10 in or more. The depth of the complementary recesses in the complementary parts can have a similar or greater dimension.

As shown in FIGS. 35-36, the cover member 140 can have one or more recesses 156*a*, 156*b* formed into the first surface 140*a* of the cover member 140 and/or the support member 104 can have one or more recesses 157*a*, 157*b* formed in the first surface 106*a* of the recess 106. With reference to FIG. 41, when a double edge blade 162 is split into two halves, it is common for the double-edged blade to have curved end portions 163 resulting from the bending process used to break the double-edged blade in half. Because of this, without such recesses, the double-edged blade may not lie flat against a completely planar surface. The curved end portions 163 can extend into any of the recesses 156 and/or 157 and permit the planar portion of the blade 162 or any similar blade to lie flat against the planar portion 140*a* of the cover member 140 and against the planar portion 106*a* of the recess 106 in the support member 104, and permit the tight, accurate, and consistent positioning of the blade 162 relative to the cover member 140 and support member 104. In any embodiments disclosed herein, one or more of the recesses can have a depth of approximately 0.02 in, or from approximately 0.015 in to approximately 0.03 in or more.

Additionally, in any embodiments disclosed herein, the razor device 100 or any other razor embodiment disclosed and described herein can have magnets, adhesive, or other biasing our coupling elements to bias a razor blade against either the support member 104 and/or against the cover member 140, making it easier for a user to hold a razor blade in the desired position for use or while tightening the cover member 140 relative to the support member 104. For example, two or more magnets 150 can be supported within respective openings or recesses 152 (such as a first recess 152*a* and a second recess 152*b*) formed in the cover member 140. The magnets and recesses can be sized such that, when the magnets are supported within the recesses, the magnets have an outer surface that is either flush or parallel to the first surface 140*a* of the cover member 140 or at least do not extend above the first surface 140*a*, thereby permitting a razor blade to lie flat against the first surface 140*a*.

Alternatively, two or more adhesive strips can be supported within the openings or recesses 152. In any embodiments disclosed herein, the magnets, posts, recesses, and other features described herein can be configured to be positioned on one or both of the support member 104 and the cover member 140. For example, one or more magnets can be positioned on either or both of the support member 104 and the blade cover member 140.

Figure 12:
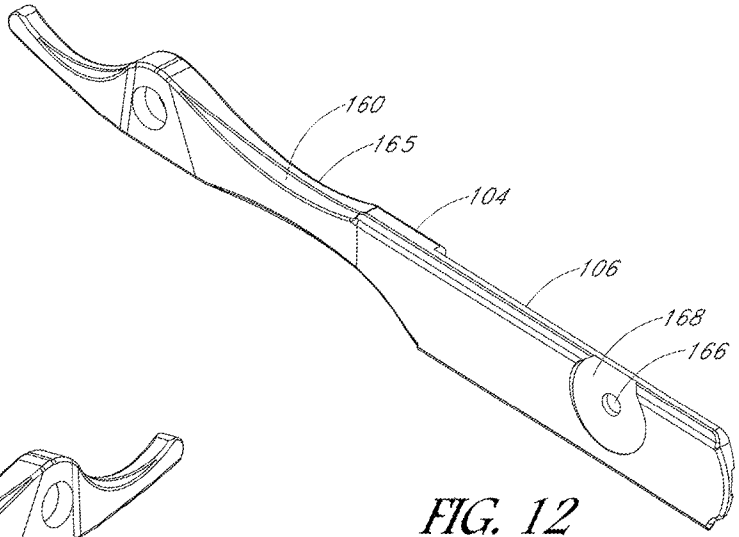
FIG. 12 is a second isometric view of the embodiment of the blade support member shown in FIG. 1.
Figure 11:
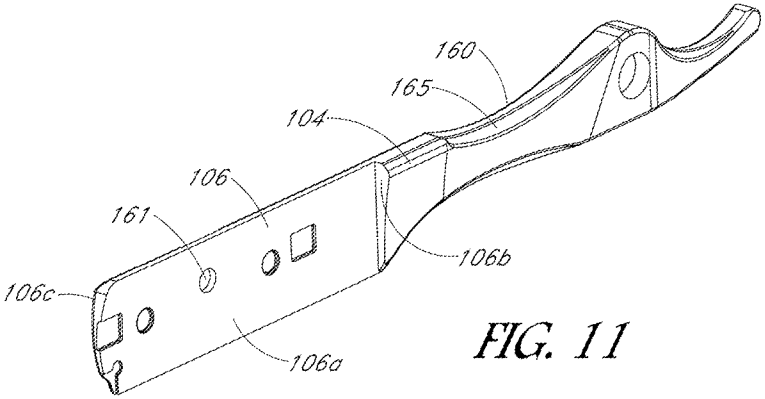
FIG. 11 is a first isometric view of the embodiment of the blade support member shown in FIG. 1.
Figure 20:
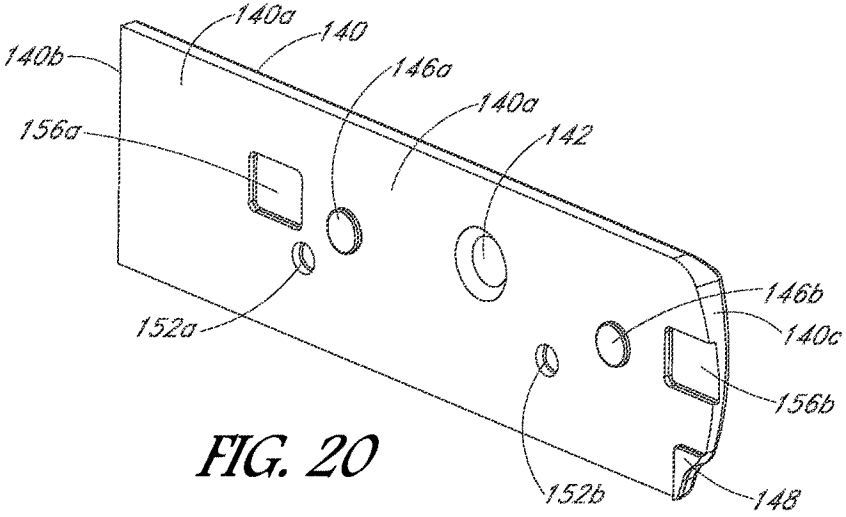
FIG. 20 is a second isometric view of the embodiment of the cover member shown in FIG. 1.
Figure 19:
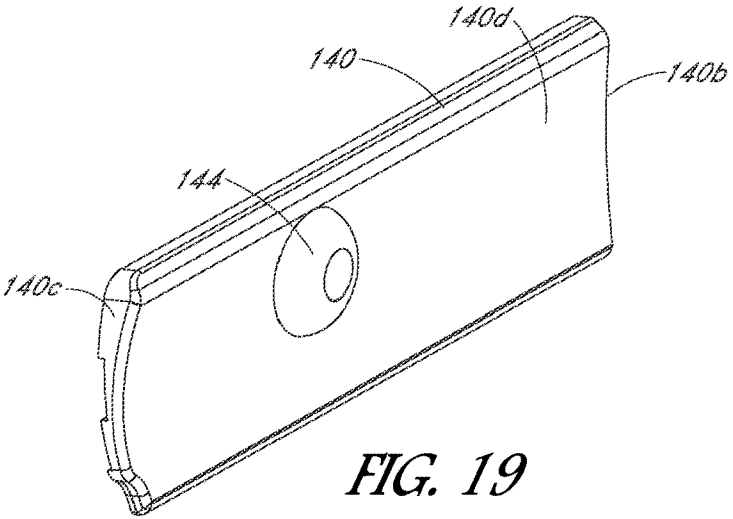
FIG. 19 is a first isometric view of the embodiment of the cover member shown in FIG. 1.
Figure 27:
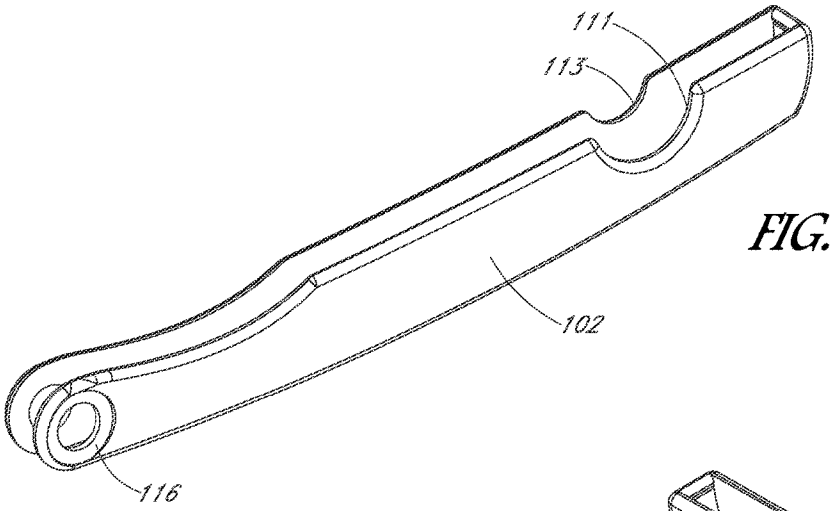
FIG. 27 is a first isometric view of the embodiment of the handle member shown in FIG. 1.
Figure 28:
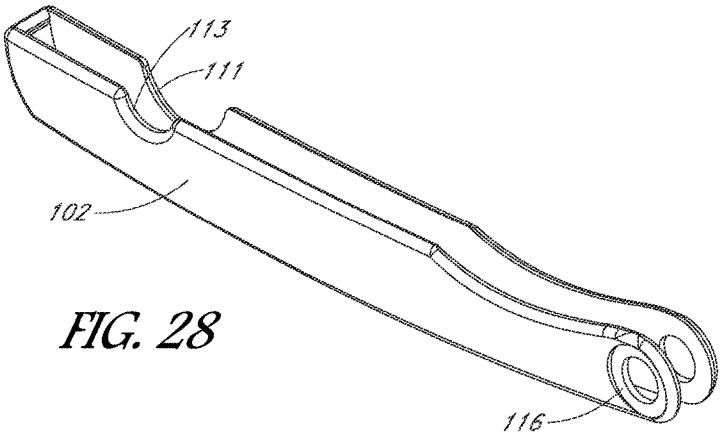
FIG. 28 is a second isometric view of the embodiment of the handle member shown in FIG. 1.
Figure 34:
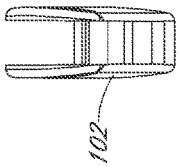
FIG. 34 is a second end view of the embodiment of the handle member shown in FIG. 1.
Figure 29:
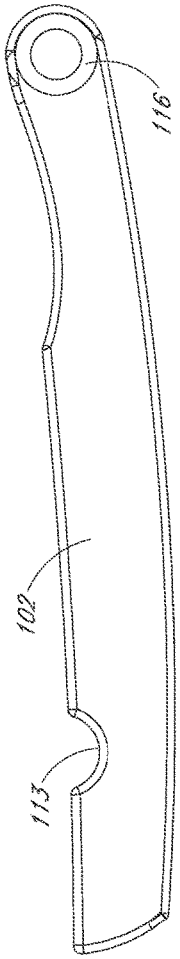
FIG. 29 is a first side view of the embodiment of the handle member shown in FIG. 1.
Figure 30:
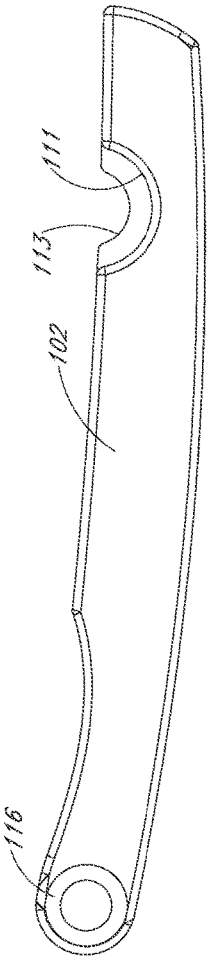
FIG. 30 is a second side view of the embodiment of the handle member shown in FIG. 1.
Figure 31:
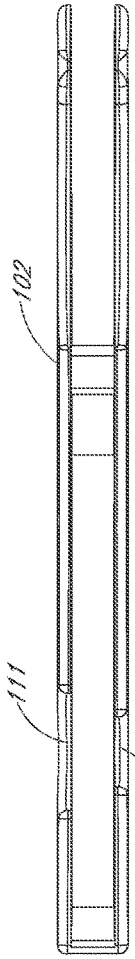
FIG. 31 is a top view of the embodiment of the handle member shown in FIG. 1.
Figure 32:
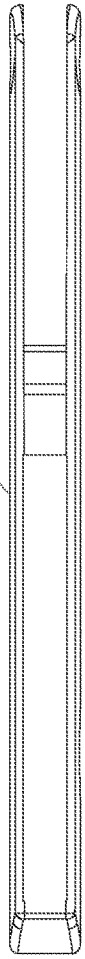
FIG. 32 is a bottom view of the embodiment of the handle member shown in FIG. 1.
Figure 33:
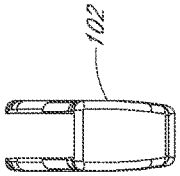
FIG. 33 is a first end view of the embodiment of the handle member shown in FIG. 1.

FIGS. 11 and 12 illustrate an embodiment of the blade support member 104. In any embodiments disclosed herein, the blade support member 104 can have a beveled edge 160 (also referred to herein as a bevel element) around all or a portion of the support member 104. As shown, the beveled edge 160 can extend around all or a portion of the tang element or portion of the support member 104 also. The bevel element 160 can improve a user's comfort, grip, and/or control over the blade support member 104 and the angle of the blade support member 104. Additionally, the support member 104 can have a curved depression or contour 165 on either side of the support member 104 configured to receive a user's thumb, forefinger, or otherwise, again to improve comfort, grip, and control over the blade support member 104. Further, a first opening 166 can be formed in the recess 106 to permit a threaded portion 110 of the fastener to extend therethrough, as well as a recess 168 configured to receive a body portion of the fastener 110 to permit a more low profile size and appearance of the razor device 100.

FIGS. 27-34 illustrate an embodiment of the handle member 102. In any embodiments disclosed herein, the handle member 102 can have a first cut out or recess 111 configured to fit partially over or around a head portion of the fastener 110. Additionally, in any embodiments disclosed herein, the handle member 102 can have a second cut out or recess 113 configured to fit partially over or around the protrusion 143 extending away from the blade cover 140.

FIG. 41 illustrates an embodiment of a razor 200 that can be used for supporting any of a variety of exchangeable blades. Any embodiments of the razor 200 disclosed herein can have any of the same features, components, sizes, materials, or other details of any of the other razor embodiments disclosed herein, including, without limitation, the razor embodiment 100, in addition to, in the alternative to, and/or in combination with any of the other features described with respect to razor 200 herein. Additionally, any embodiments of the razor 100 disclosed above can have any of the features, components, sizes, materials, or other details of razor embodiment 200 disclosed herein, in addition to, in the alternative to, and/or in combination with any of the other features described with respect to razor 100 herein.

In some embodiments, the razor 200 can have a handle member 202 (also referred to as a handle element or portion), a blade support member 204 (also referred to herein as a blade support element or portion or blade support) that can be attached to the handle member 202 and can be rotatable relative to the handle member 202, and a blade cover member 240 (also referred to as a cover plate or blade cover) coupleable with the blade support member 204.

In any embodiments disclosed here, the blade cover member 240 can be coupleable with the blade support member 204 using any suitable techniques and/or fasteners. In any embodiments, the blade cover member 240 can be removably couplable with the support member 204 and/or be rotatable relative to the support member 204. With reference to the Figures, any embodiments of the blade support member 204 can have a recess 206 sized and shaped such that a perimeter of the recess 206 substantially matches a size and shape of a profile or perimeter of the blade cover member 240. The cover member can be coupled with the blade support member such that the cover member fits within or adjacent to the recess 206. For example and without limitation, any embodiments of the razor disclosed herein can have a blade support member 204 having a recess 206 formed therein, the recess 206 having a first surface 206*a*, a first end or edge 206*b*, and a second end or edge 206*c*. Any embodiments of the cover member 240 can have a first surface 240*a*, a first end or edge 240*b*, and a second end or edge 240*c*. The first edge 206*b* and second edge 206*c* of the recess can substantially match the first edge 240*b* and second edge 240*c* of the cover member 240 so that, when the cover member 240 is removably coupled to the support member 204, the cover member 240 substantially fits within the recess 206 and matches a perimeter shape of the recess 206.

In any embodiments disclosed herein, the recess (including, but not limited to, the recess 206) can extend from a top of the blade support member 204 to a bottom of the blade support member 204. Additionally, in any embodiments, the recess can extend from an end of the blade support member 206 toward the opening 218 a distance that is approximately the same as, or slightly greater than, or between approximately 10% greater to approximately 20% greater than, or between approximately 20% greater than to approximately 30% greater or more than, a width of a razor blade supportable by the razor device. As mentioned above, without limitation, any razor device disclosed herein can support a double-edge razor blade that has been split in half, a standard injector blade, a Feather injector blade, and any other similar razor blade or other single use or other razor blade commonly used for straight razor shaving.

In any embodiments disclosed herein, the cover member (including, without limitation, cover member 240) can have approximately a same perimeter shape and approximately a same width and length as the recess of the razor device that the cover member is coupled against. Additionally, in any embodiments disclosed herein, the cover member can have a different shape than the recess and/or have a different width and/or length as the recess of the razor device that the cover member is coupled against. The cover member overlap one or more edges of the recess and abut against the support member.

In any embodiments disclosed herein, the cover member (such as cover member 240) can be configured to rotate relative to the blade support member (such as blade support member 204) such that, when the fastener 210 is sufficiently or substantially loosened, a user can rotate the cover member relative to the blade support member to permit the removal, addition, or replacement of the razor blade. For example and without limitation, razor 200 can be configured such that a user can loosen the fastener 210 with his or her thumb and, without completely removing the fastener 200, the user can rotate the cover member 240 about the shaft or threaded portion of the fastener 210 and insert, remove, or replace the razor blade without completely removing the cover member 240 or fastener 210. This is a more efficient method of replacing the razor blade than in other products existing in the market, saving the barber time and also reducing the likelihood of injury during blade replacement and/or loss of the fastener, cover member, or other parts during the replacement of the razor blade.

For example and without limitation, in any embodiments disclosed herein, the first edge 206*b* of the recess and the first edge 240*b* of the cover member 240 can be substantially curved or rounded, or otherwise sized and shaped such that the cover member 240 can be rotated about fastener 210 after the fastener 210 has been loosened. In any embodiments disclosed herein, the second edge 206*c* of the recess 206 and the second edge 240*c* of the cover member 240 can be generally curved. Additionally, in any embodiments disclosed herein, the cover member 240 can have a length that is approximately 20% greater than a length of a razor blade to be supported between the cover member 240 and the support member 204, or from approximately 10% to approximately 20%, or from approximately 20% to approximately 30% greater than a length of a razor blade to be supported between the cover member 240 and the support member 204. As used throughout this disclosure, the terms approximately and substantially are meant to designate a dimension or value that is within 10% or less of the stated dimension or value.

In any embodiments disclosed herein, the blade cover 240 can be removably coupled with the support member 204 using the threaded fastener 210. Coupling the cover member 240 with the support member 204 using, for example and without limitation, the fastener 210, can exert a compression force on a razor blade positioned between the first surface 206*a* of the recess 206 and the first surface 240*a* of the cover member 240 that is sufficient to hold the razor blade in the desired position relative to the support member 204 and the cover member 240. In any embodiments disclosed herein, a frictional force from the first surface 206*a* of the recess 206 and/or the first surface 240*a* of the cover member 240 can be used to hold the razor blade in the desired position. Additionally, in any embodiments disclosed herein, a magnetic or adhesive force applied to the razor blade from magnets or adhesive supported by one or both of the support member 204 and/or the cover member 240 can be used to hold the razor blade in the desired position.

In any embodiments disclosed herein, the threaded fastener can be a screw type fastener. The threaded fastener 210 can, for example and without limitation, be a thumbscrew wherein a portion of a head portion of the fastener 210 can extend above a top surface or perimeter of the support member 104 such that a user of the razor device 200 or any other razor device embodiment disclosed herein can easily rotate the fastener 210 by moving the user's thumb or finger or other object relative to the fastener along, or by exerting a tangential force on, the portion of the fastener 210 (for example, a portion of the head of the fastener) that extends above the perimeter or a top surface of the support member 204. In this configuration, the user can easily tighten or loosen the fastener 210 relative to the blade cover 240 using the fastener 210. An edge surface or main surface of the head of the fastener 210 can have ridges, notches, bumps, channels, protrusions, pits, gripping elements, or other similar features or texture to increase a friction or grippiness of the edge or main surface of the head of the fastener to make it easier for a user to loosen or tighten the fastener with, for example and without limitation, a user's thumb or forefinger, during use. In this configuration, in any embodiments disclosed herein, the cover member can be loosened relative to the blade support member so as to permit the removal, addition, or exchange of razor blades without the use of tools.

The threaded fastener 210 can, for example and without limitation, be a thumbscrew wherein a portion of the perimeter of the fastener 210 extends above a top surface or perimeter of the support member 204 such that a user of the razor device 200 can easily rotate the fastener 210 by translating the user's thumb or finger or other object along the portion of the fastener 210 that extends above the perimeter of the support member 204. In this configuration, the user can easily tighten or loosen the fastener 210 relative to the blade cover 240 using the fastener 210. In any embodiments disclosed herein, the blade cover 240 can have a threaded opening or recess 242 therein configured to receive a threaded end portion of the fastener 210. The threaded opening 242 can be formed through a thickness of the cover member 240 and can extend into a boss or protrusion 244 extending away from a back surface 240*d* of the cover member. The opening 242 can extend partially or completely through the boss or protrusion 244.

In any embodiments disclosed herein, the opening or recess (such as the opening or recess 242), can be located at any desired position along the length of the cover member 240. For example, in any embodiments, the opening can be positioned near the midpoint of the cover member, or between a midpoint and a point that is approximately ⅔ along a length of the cover member from a first end (such as first end 240*b*) of the cover member toward a second end (such as second end 240*c*) of the cover member. In any embodiments disclosed herein, the recess can be at a position that is approximately 55% to approximately 65% along the length of the cover member 240. Additionally, in any embodiments disclosed herein, the recess 242 and hence the fastener 210 can be positioned on the razor 200 at a position that is approximately located at the middle of a length of the position of the razor blade that is supported within the razor 200. The fastener can be located along an edge of the razor opposite to the side of the razor having the razor blade.

With reference to FIGS. 19-26, in any embodiments of the cover member 240 disclosed herein, the cover member can have a protrusion 243 substantially aligned with the opening or recess 242. The protrusion 243 can be configured to provide additional material and/or thickness for the recess 242, to increase the depth of the opening or recess 242 without increasing the overall thickness of the cover member 240. The protrusion 243 can have a thickness or height that is approximately equal to a thickness of the cover member 240 is between approximately 75% and approximately 90% the thickness of the cover member 240.

Additionally, as will be described in greater detail below, the fastener 210 can be configured such that, as a user loosens the fastener 210 relative to the blade cover 240, the fastener 210 will merely rotate and not translate relative to the support member 204, such that the fastener 210 is always or is at least biased to substantially remain in a fixed translational position in the axial direction relative to the support member 204, or to remain substantially connected to the support member 204 so that the fastener does not get lost or removed from the body portion 206. For example, without limitation, in some embodiments, a base portion of the threaded shaft or threaded portion of the fastener 210 can have a smaller diameter than a threaded portion of the shaft and be unthreaded.

Figure 42:
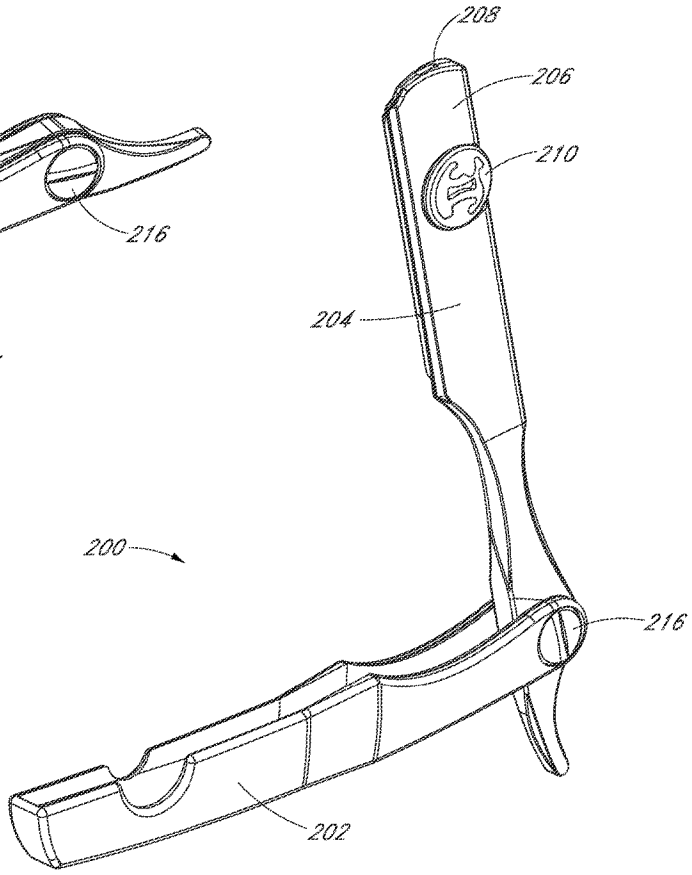
FIG. 42 is an isometric view of the embodiment of the razor shown in FIG. 41 in a partially open state or position.
Figure 43:
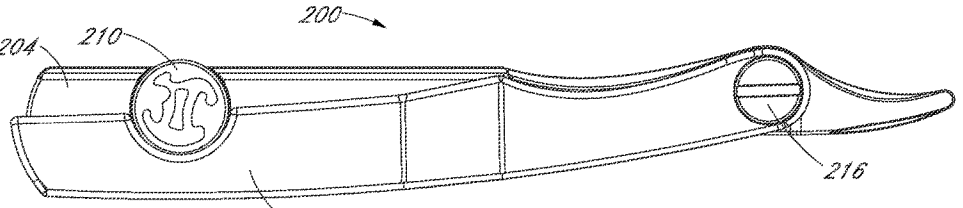
FIG. 43 is a first side view of the embodiment of the razor shown in FIG. 41.
Figure 47:
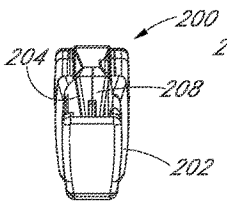
FIG. 47 is a first end view of the embodiment of the razor shown in FIG. 41.
Figure 48:
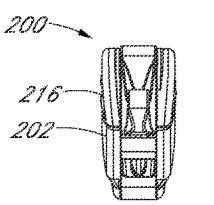
FIG. 48 is a second end view of the embodiment of the razor shown in FIG. 41.
Figure 44:
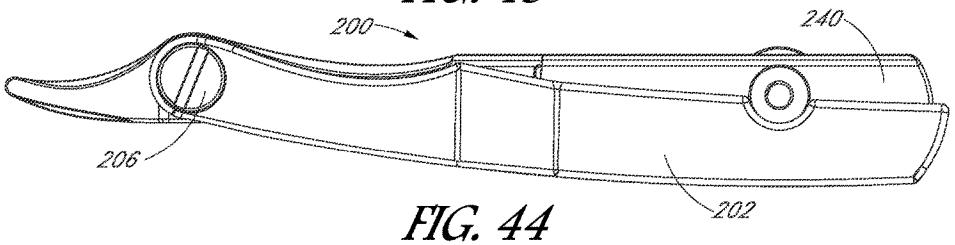
FIG. 44 is a second side view of the embodiment of the razor shown in FIG. 41.
Figure 45:
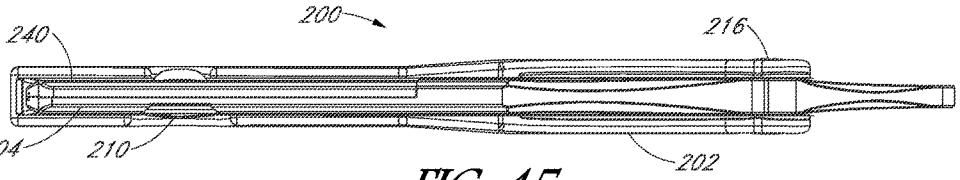
FIG. 45 is a top view of the embodiment of the razor shown in FIG. 41.
Figure 46:
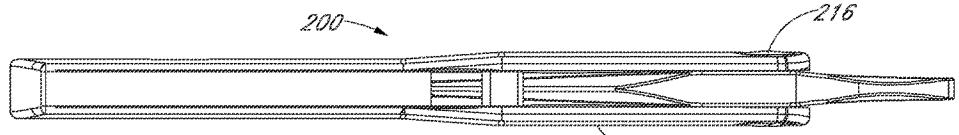
FIG. 46 is a bottom view of the embodiment of the razor shown in FIG. 41.
Figure 49:
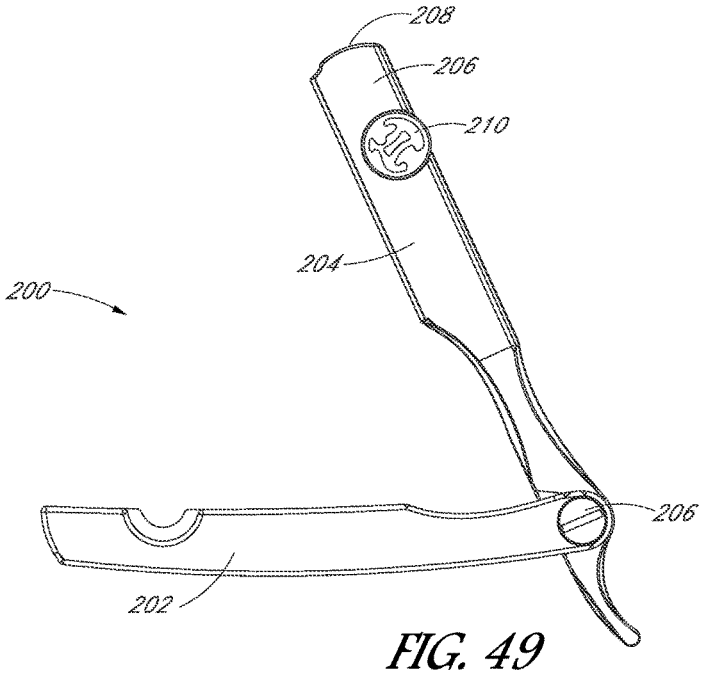
FIG. 49 is a first side view of the embodiment of the razor shown in FIG. 41 in a partially open state or position.
Figure 50:
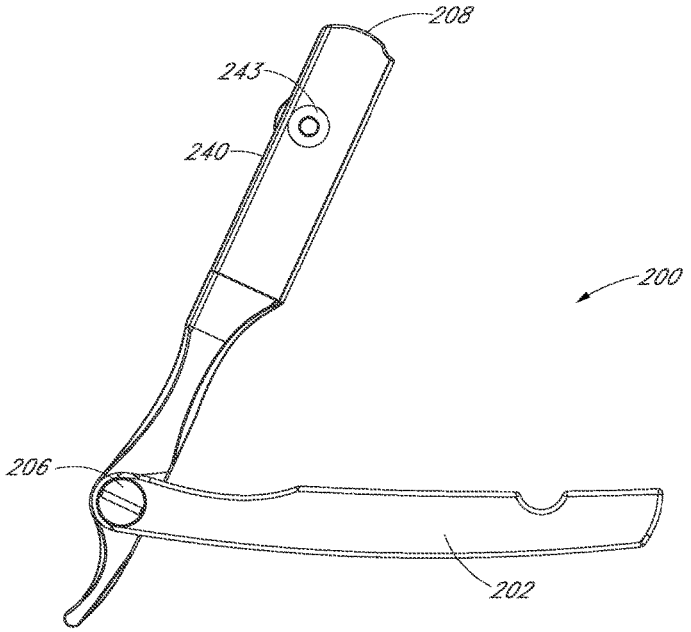
FIG. 50 is a second side view of the embodiment of the razor shown in FIG. 41 in a partially open state or position.
Figure 51:
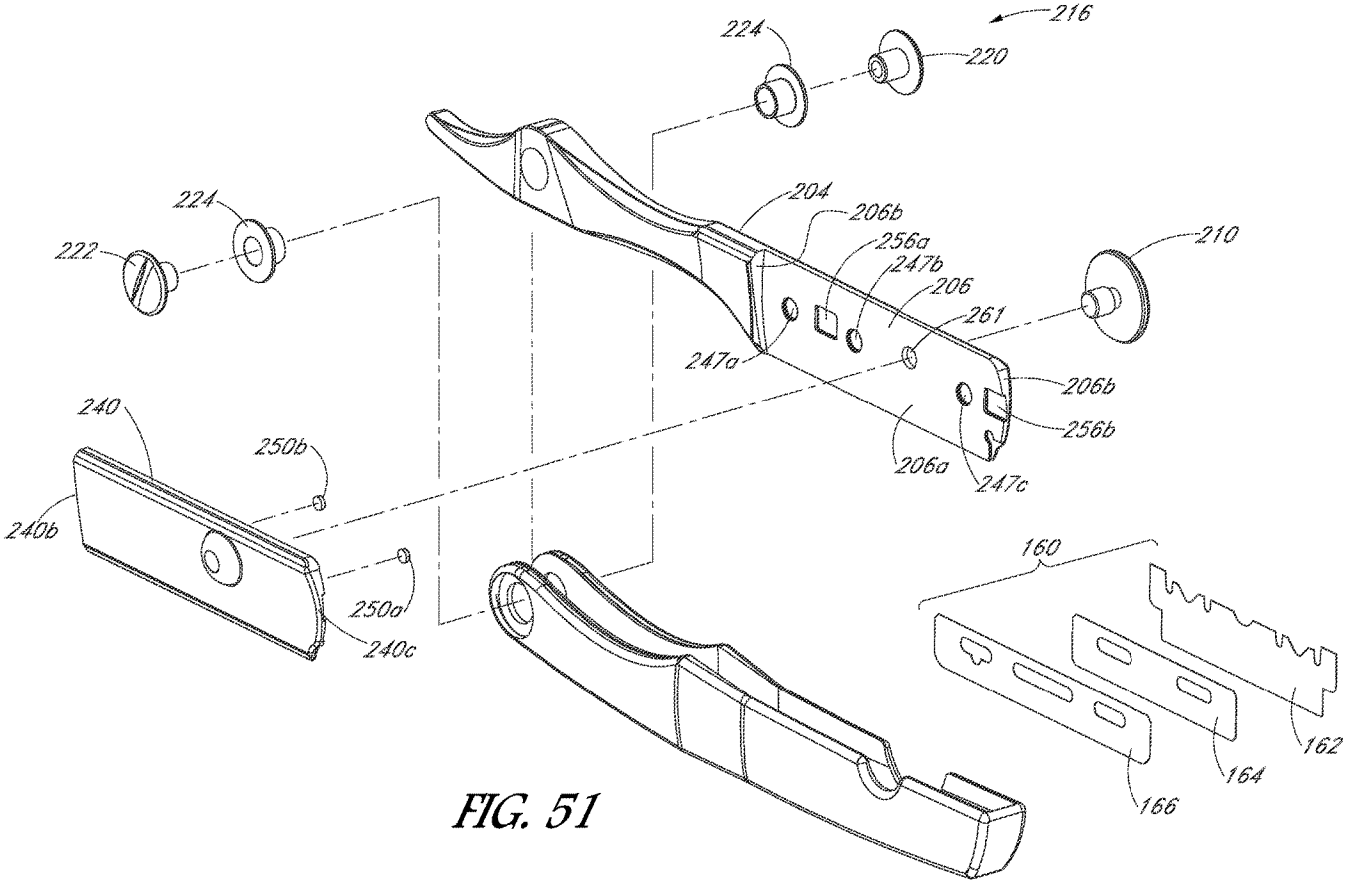
FIG. 51 is a first exploded view of the embodiment of the razor shown in FIG. 41.
Figure 52:
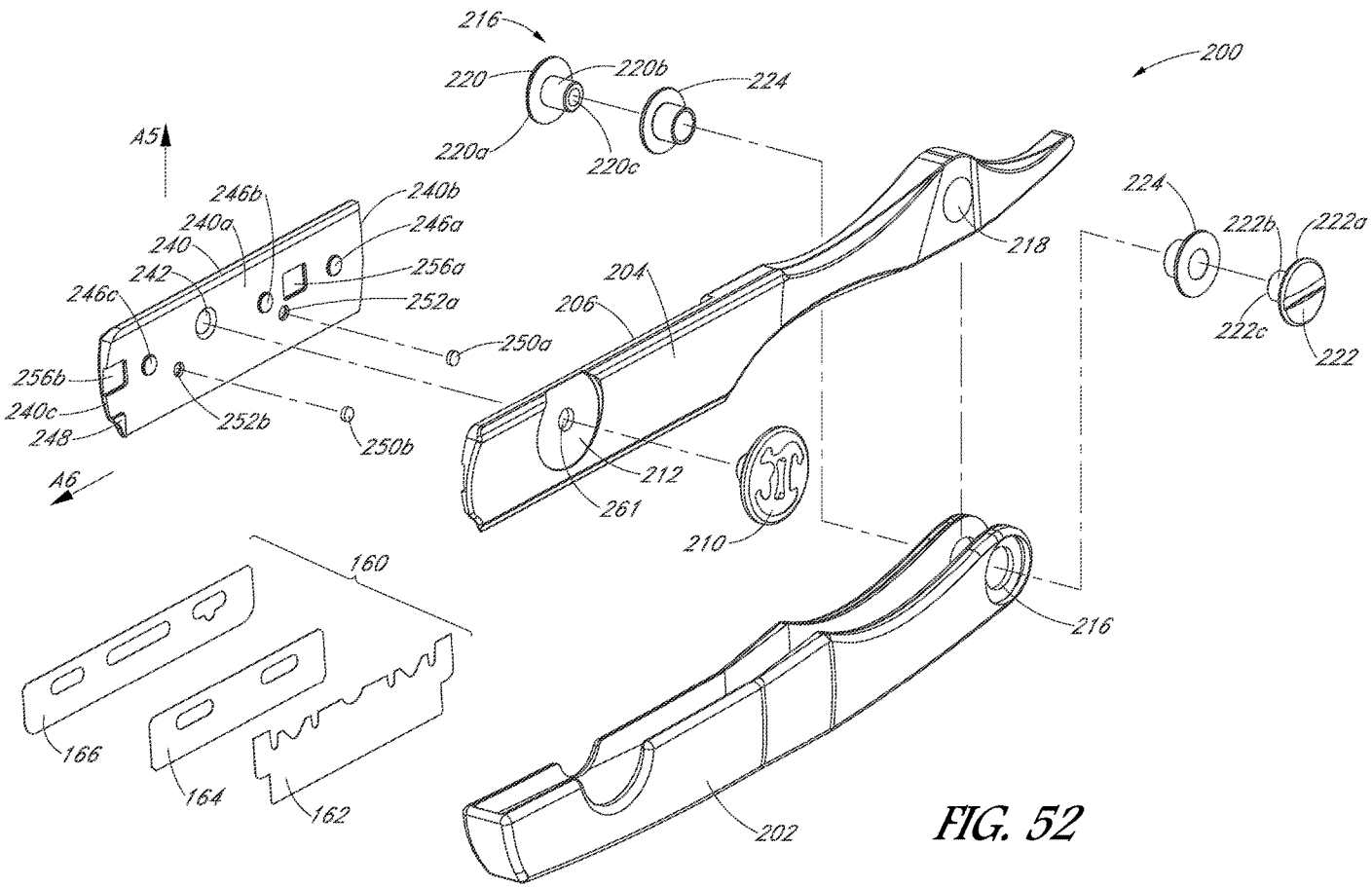
FIG. 52 is a second exploded view of the embodiment of the razor shown in FIG. 41.
Figure 53:
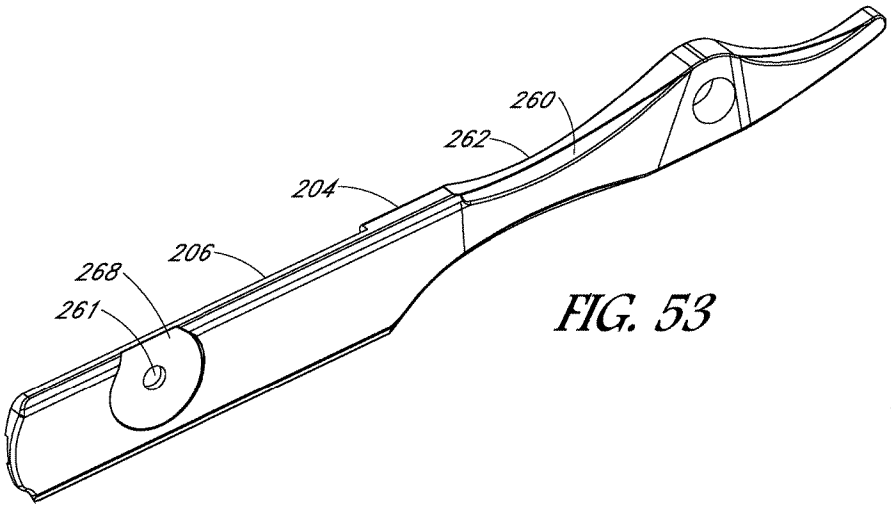
FIG. 53 is a first isometric view of the embodiment of the blade support member shown in FIG. 41.
Figure 54:
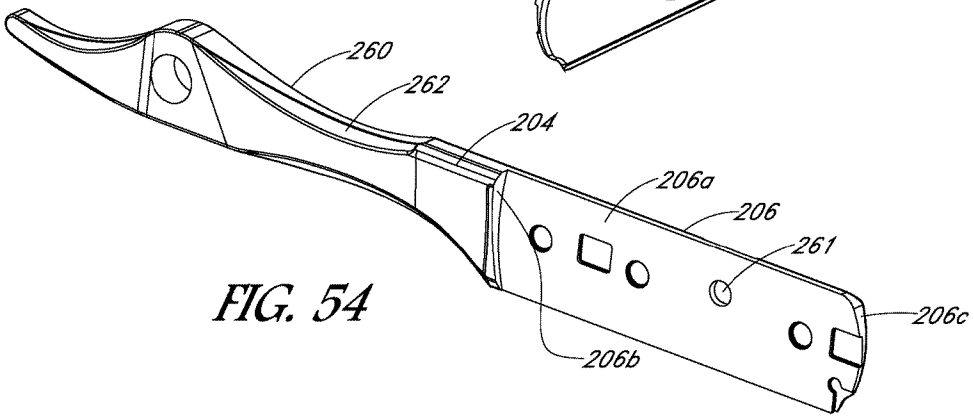
FIG. 54 is a second isometric view of the embodiment of the blade support member shown in FIG. 41.
Figure 56:
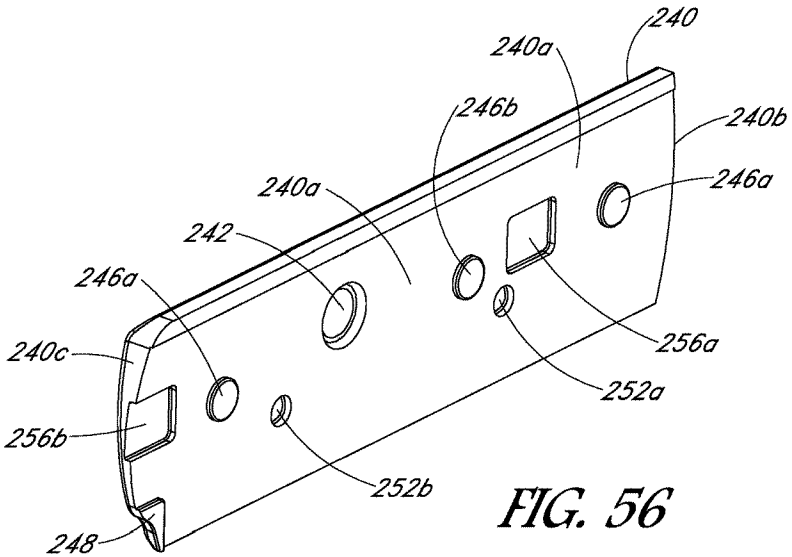
FIG. 56 is a second isometric view of the embodiment of the cover member shown in FIG. 41 in a partially open state or position.
Figure 55:
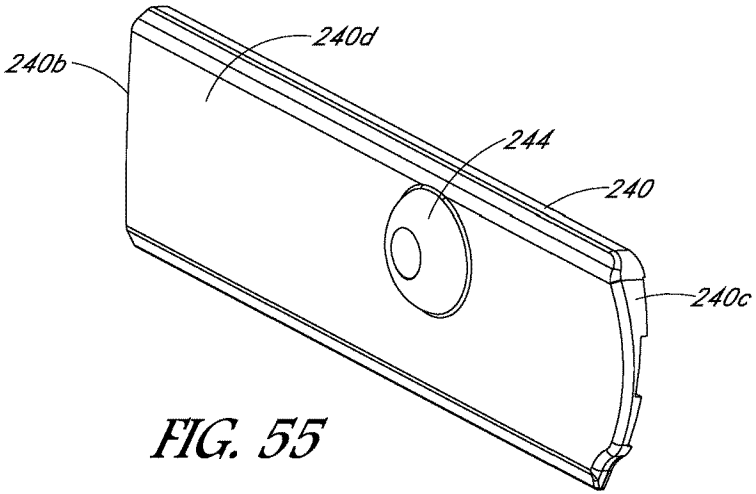
FIG. 55 is a first isometric view of the embodiment of the cover member shown in FIG. 41 in a partially open state or position.
Figure 60:
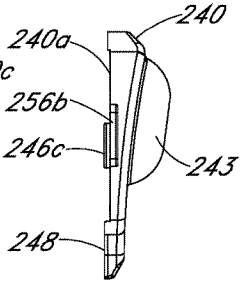
FIG. 60 is a second end view of the embodiment of the cover member shown in FIG. 41.
Figure 57:
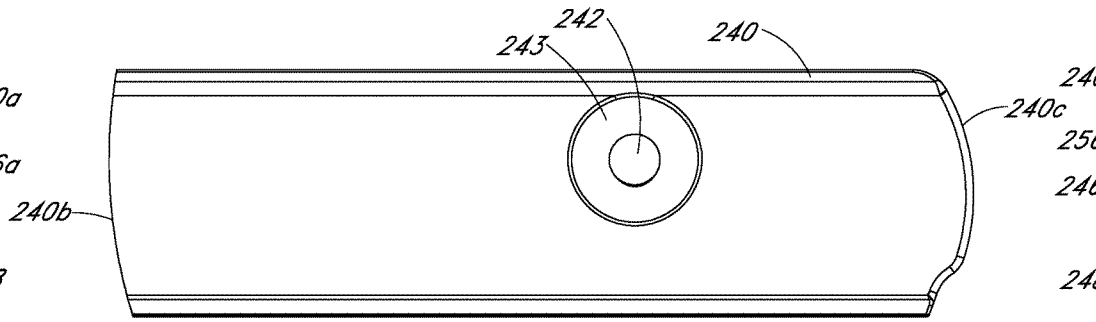
FIG. 57 is a first side view of the embodiment of the cover member shown in FIG. 41.
Figure 58:
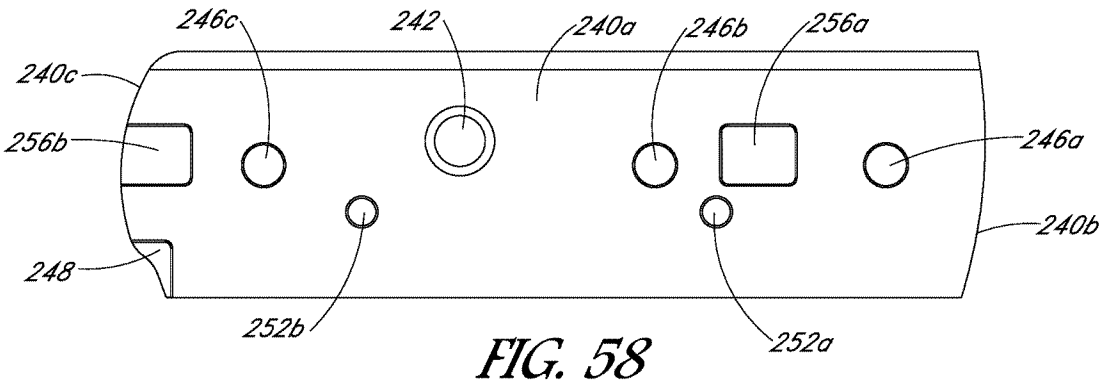
FIG. 58 is a second side view of the embodiment of the cover member shown in FIG. 41.
Figure 59:
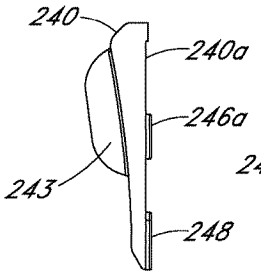
FIG. 59 is a first end view of the embodiment of the cover member shown in FIG. 41.

With reference to FIG. 42, the support member 204 can be coupled with the handle element 202 using any suitable techniques or fasteners, such as without limitation the fastener assembly 216. In any embodiments disclosed herein, without limitation, the fastener assembly 216 can be configured to pass through one or more openings in the handle member 202 and one or more openings 218 in the blade support member 204 and provide an axle or shaft about which one or both of the cover member 202 and the blade support member 204 can rotate. In some embodiments, as illustrated in FIGS. 51 and 52, the fastener 216 can comprise a first fastener element 220, a second fastener element 222, and a threaded member 224 configured to couple the first fastener element 220 with the second fastener element 222.

In any embodiments disclosed herein, the first fastener element 220 can have a flange portion 220*a*, a body portion 220*b*, and a recess or opening 220*c* that extends axially through all or a portion of the body portion 220*b*. Similarly, the second fastener element 222 can have a flange portion 222*a*, a body portion 222*b* and a recess or opening 222*c* that extends axially through all or a portion of the body portion 222*b*. In the illustrated embodiments, the openings 220*c* and

222*c* extend only partially through the body portions of the respective fastener elements. Additionally, the body portions 220*b*, 222*b* can have a cylindrical surface sized to be slightly smaller than one or both of the openings 216, 218 and configured to permit the cover member 202 and/or the blade support member 204 to easily rotate about the body portions 220*b*, 222*b*. Additionally, in some embodiments, the fastener 216 can also include a threaded member 224 that can threadedly engage threaded recesses 220*c*, 222*c* so as to couple the first fastener element 220 with the second fastener element 222. Alternatively, the fastener member 216 can be configured such that either the first fastener element 224 the second fastener element 222 can have a threaded shaft extending axially from the body portion thereof (so as to be formed integrally or monolithically with the body portion), configured to engage a threaded recess in the other of the first fastener element and the second fastener element. Thread lock or other similar features or substances can be used to prevent the inadvertent loosening of any of the fasteners disclosed herein.

Any of the embodiments of the razor device disclosed herein, such as, without limitation, the razor device 200, can be configured to work with any of a variety of razor blades available on the market. For example and without limitation, any of the razor device embodiments disclosed herein can be configured to receive and support any of the three razor blades shown in FIG. 51, which include a double-edge razor blade 162 that has been split in half (as shown), a standard injector blade 164 (also referred to as a mini shaper blade), and a Feather injector blade 166 (also referred to as a Feather "Artist Club" Blade or Kai "Captain" blade). Additionally, any embodiments of the razor device 200 or any of the razor device embodiments disclosed herein can be configured to support an entire double-edge razor blade in its intact, double-edge configuration, or any other suitable or available blade. For example, a height of the body member and/or the cover member can be increased so as to cover one of the two edges of the double-edge razor blade, thereby permitting a user to simply remove and rotate the double-edge razor blade to change the side of the double-edge razor blade that is exposed and usable for shaving or trimming.

With reference to FIGS. 51-60, the blade cover member 240 can have a threaded opening 242 extending partially or fully through the cover member 240, configured to receive a threaded portion of the fastener 210. An opening 261 can be formed through the blade support member 204 to permit the fastener 210 to pass through the support member 204 and engage the opening 242 in the cover member 240. In any embodiments disclosed herein, the fastener 210 can be a threaded fastener having threads thereon that thread into the opening 242. In any embodiments disclosed herein, the opening 242 can have internal threads formed thereon. By tightening the fastener after a razor blade has been positioned between the first surface 240*a* of the cover member 240 and the first surface 206*a* of the recess 206 formed in the support member 204, or against the first surface 240*a* of the cover member 240 or against the first surface 206*a* of the recess 206 formed in the support member 204, the razor blade can be tightly secured between the blade support member 204 and the cover member 240.

To remove the blade, the user can loosen the fastener 210 to remove the cover member 240 from the coupled position with the support member 204 and then simply remove the razor blade. Alternatively, as described above and as shown in FIG. 61-62, in any embodiments described herein, with the fastener in a partially or completely state or position, the cover member 240 supporting the razor blade can be rotated about the fastener 210 in a direction indicated by arrows A3 so that the cover member 240 is no longer aligned with the support member 204, toward the position shown in FIG. 61. In this position, the blade, such as blade 162 can be removed from its position against the cover member 240 by sliding the blade 162 in the direction indicated by arrow A4 in FIG. 62 to remove the blade. The fastener 210 may need to be loosened a sufficient amount to permit the razor to clear the protrusions extending away from the first surface 240*a* of the cover member, and to permit any curved edges of the razor blade to clear the cover member 240 or support member 204.

Figure 61:
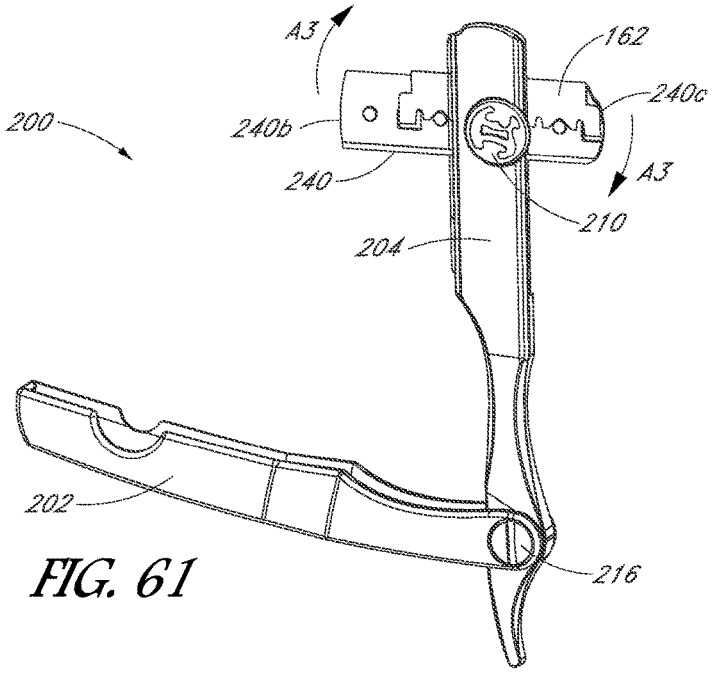
FIG. 61 is a first isometric view of the embodiment of the razor of FIG. 41 in an open position, showing the cover member rotated to a position wherein the razor blade can be removed from the razor.
Figure 62:
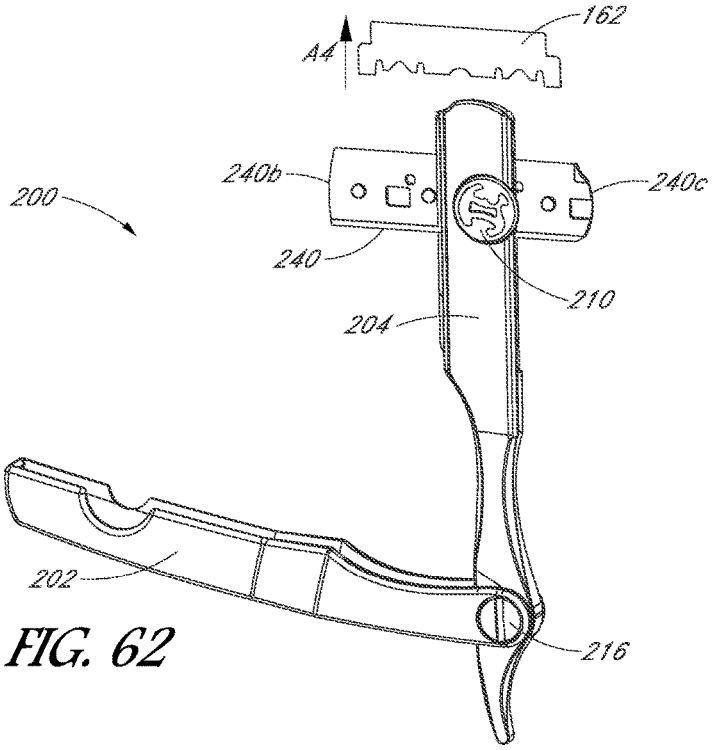
FIG. 62 is a second isometric view of the embodiment of the razor of FIG. 41 in an open position, showing the cover member rotated to a position wherein the razor blade can be removed from the razor.
Figure 63:
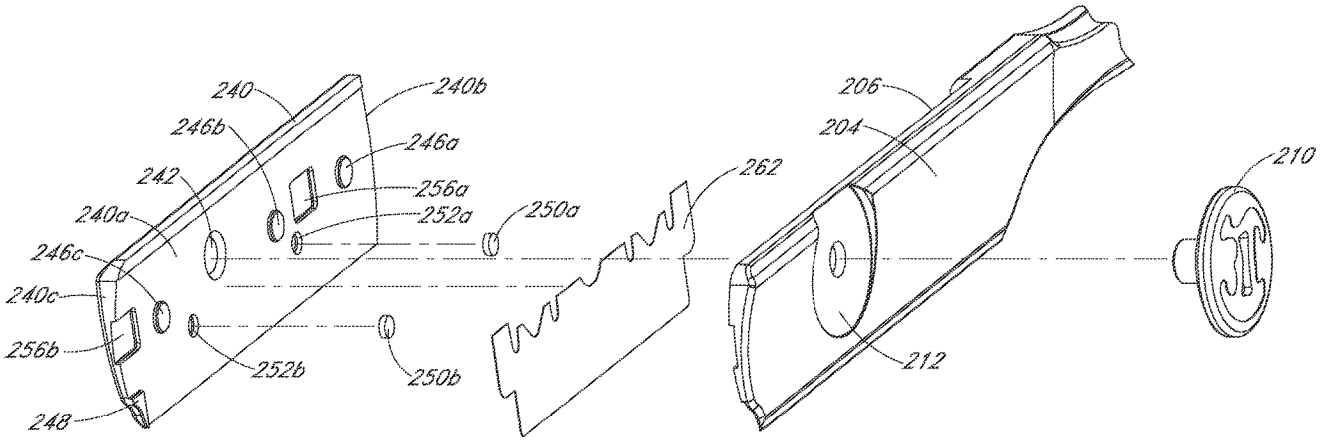
FIG. 63 is an exploded view of a portion of the embodiment of the razor shown in FIG. 41.
Figure 65:
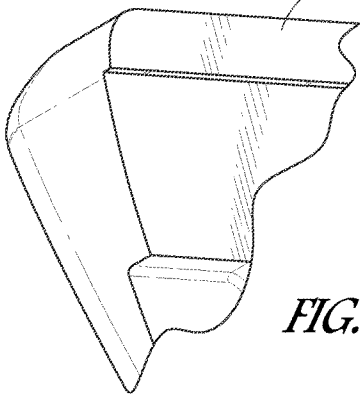
FIG. 65 is an enlarged detailed view of the embodiment of the cover member shown in FIG. 64.
Figure 64:
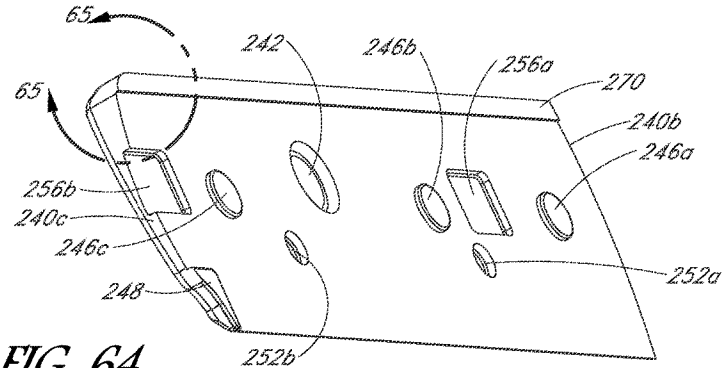
FIG. 64 is an isometric view of an embodiment of a cover member.
Figure 67:
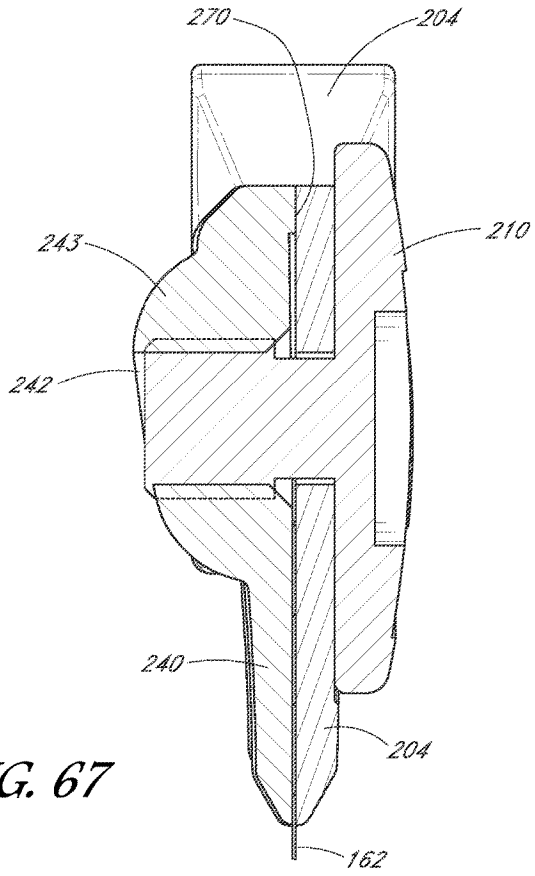
FIG. 67 is a section view of the embodiment of the razor shown in FIG. 66 take through line 67-67 in FIG. 66.
Figure 66:
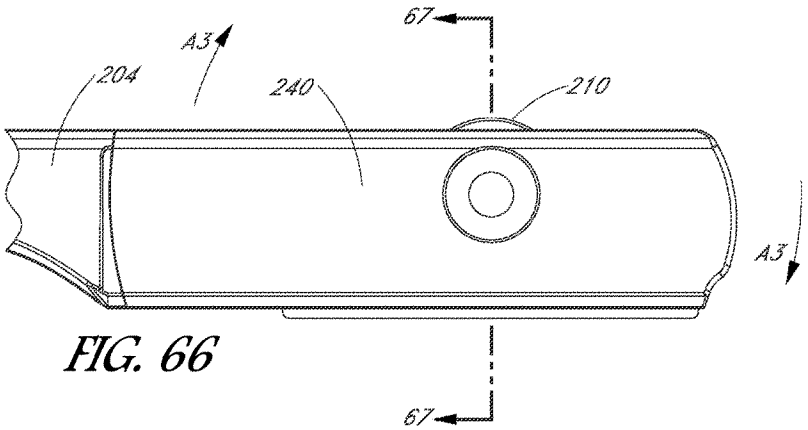
FIG. 66 is a side view of a portion of the embodiment of the razor shown in FIG. 41.
Figure 68:
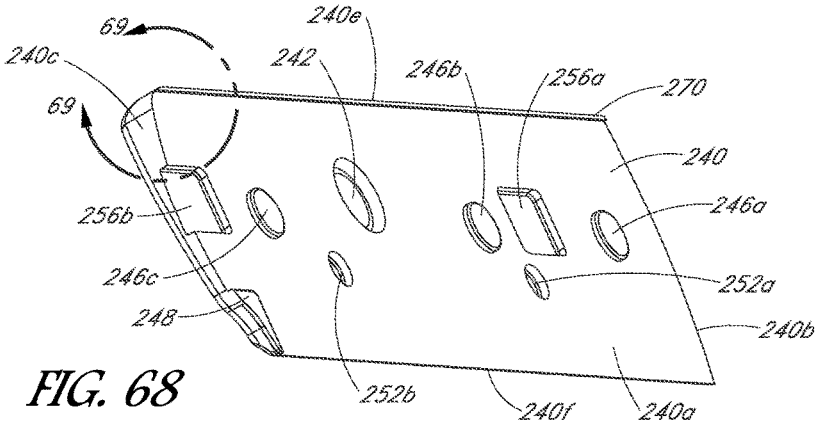
FIG. 68 is an isometric view of another embodiment of a cover member.
Figure 69:
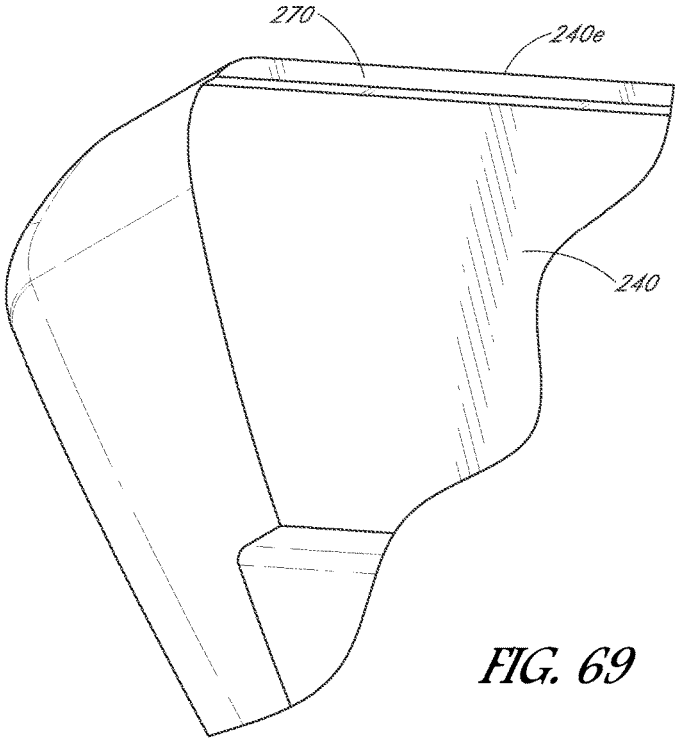
FIG. 69 is an enlarged detailed view of the portion of the cover member shown in FIG. 68.

In any embodiments disclosed herein, the razor can be configured such that, when the fastener 210 is loosened and the cover member 240 is in the initial position wherein the cover member 240 is substantially or completely aligned with the recess 206 (for example, as shown in FIG. 66), the cover member can only be rotated in one (or a first) direction, for example the direction indicated by arrows A3 shown in FIG. 61. With reference to FIG. 66, any embodiments of the razor can be configured such that the cover member 240 can only rotate in the direction represented by arrow A3, and not in the opposite direction. The first edge 206*b* of the recess 206 can be configured so as to prevent or physically impede a rotation of the cover member 240 in the direction opposite to A3.

A new blade can be inserted into the razor in the opposite way. For example, the new razor blade can be inserted against the cover member, the cover member can be rotated to substantially align the cover member with the recess 206 in the support member 204 (by rotating the cover member 240 in the opposite direction as arrows A3 shown in FIG. 61), and then tightening the fastener 210.

Additionally, in any embodiments disclosed herein, the blade cover member 240 can also have one or more stops 246, which can be posts or bosses extending from a first surface 240*a* (which can be generally planar). For example and without limitation, the cover member 240 can have a first stop element 246*a*, a second stop element 246*b*, and a third stop element 246*c* extending from the first surface 240*a* of the cover member 240. The stop elements 246 can be sized and positioned to provide a limit or a stop to limit a movement or translation of the razor blade to be supported against the cover member 240 and/or to permit the precise positioning of the razor blades relative to the cover member 240, the support member 204, and/or any other components of the razor 200.

For example, when a razor blade is positioned such that a planar surface of the razor blade is adjacent or abutting against to the surface 240*a* of the cover member 240, the stop elements 246 can limit or prevent the movement of the razor blade in the direction represented by arrow A5 shown in FIG. 52. In this configuration, the alignment posts or stops 246 can thereby allow for the accurate and consistent positioning of the razor blade relative to the cover member 240 and hence relative to the support member 204 so that a user of the razor blade device 200 is able to accurately and safely perform cutting operations using the razor device 200, knowing that the razor blade is supported within the support member 204 at or nearly at the same position every time a razor blade is installed in the razor 200.

Additionally, in any embodiments disclosed herein, the razor device can be configured such that any of the three types of blades that can be supported by the razor device, or any other similar or suitable types of blades, can be uniformly supported by the razor device. By uniformly supported, it is meant that, regardless of the razor blade type, the razor device (including, but not limited to, device 200) can be sized and configured such that the length that the blade extends away from the blade support member 204, the cover member 240, or other component or feature of the razor device is approximately the same. Ensuring that the exposed length of the blade (i.e., the distance of the blade extending away from the razor device) can provide for greater consistency and accuracy to the user of the razor device. For example, the stop elements 246 can be sized and configured to ensure that the length of the exposed portion of the blade is consistent from one blade to the next that is supported by the razor device, regardless of the type of blade.

Additionally, the support member 204 can have one or more recesses 247 (such as recesses 247*a* and 247*b*) formed in the recess 206 and sized and positioned to permit the stop elements 246 to extend therein, thereby permitting the planar face 240*a* of the cover member 240 and the planar face 206*a* of the recess formed in the support member 204 to couple substantially completely together and thereby compress the razor blade therebetween. The stop elements 246 and the recesses 247 can also assist in the accurate alignment of the cover member relative to the support member in any embodiments disclosed herein. Any of the stop members, protrusions, bosses, or recesses, can have angled and/or curved surfaces to facilitate the engagement of such features with the complementary features on the adjoining parts or components.

Similarly, in any embodiments disclosed herein, the cover member 240 can have a third stop element 248 (also referred to as a lengthwise stop) extending from the first surface 240*a* of the cover member 240. The stop element 248 can be sized and positioned to provide a limit or a stop to limit a movement or translation of the razor blade to be supported against the cover member 240 in the direction represented by Arrow A6 shown in FIG. 52. For example, for the configuration illustrated FIG. 52, when a razor blade is positioned such that a planar surface of the razor blade is adjacent or abutting against to the surface 240*a* of the cover member 240, a user can slide the razor blade in the direction represented by arrow A6 until the razor blade contacts the third stop element 248, thereby consistently positioning an end of the razor blade relative to the cover member 240 and, hence, the support member 204, regardless of the length of the razor blade. In this configuration, the end portion of the razor blade will always be positioned at the same proximity to or distance from the end of the cover member 240 and the support member 204 so that a user of the razor device 200 will be permitted to accurately and safely perform cutting operations with the razor device 200 regardless of the size of the razor blade that is supported within the razor device 200.

As shown, the third stop element 248 can be positioned near or adjacent to the second end 240*c* of the cover member 240 and/or at or adjacent to a bottom edge 240*d* of the cover member 240. As shown in FIGS. 35-36, a complementary recess 249 can be formed in the support member 204, being sized and configured such that the third stop element 248 can extend into the recess 249.

Any of the stops or protrusions 246, 248 can extend away from this first surface 240*a* to a height or thickness that is approximately equal to an average thickness of any razor blade that can be supported by the razor 200. For example, the protrusions 246, 248 can have a height of approximately 0.005 in to approximately 0.025 in. Additionally, in any embodiments disclosed herein, the height of any of the protrusions can be from approximately 0.010 in to approximately 0.050 in or more, or up to approximately 0.10 in or more. The depth of the complementary recesses in the complementary parts can have a similar or greater dimension.

As shown in FIGS. 35-36, the cover member 240 can have one or more recesses 156*a*, 156*b* formed into the first surface 240*a* of the cover member 240 and/or the support member 204 can have one or more recesses 257*a*, 257*b* formed in the first surface 206*a* of the recess 206. As described above, when a double edge blade 162 is split into two halves, it is common for the double-edged blade to have curved end portions 163 resulting from the bending process used to break the double-edged blade in half. Because of this, without such recesses, the double-edged blade may not lie flat against a completely planar surface. The curved end portions 163 can extend into any of the recesses 256 and/or 257 and permit the planar portion of the blade 162 or any similar blade to lie flat against the planar portion 240*a* of the cover member 240 and against the planar portion 206*a* of the recess 206 in the support member 204, and permit the tight, accurate, and consistent positioning of the blade 162 relative to the cover member 240 and support member 204. In any embodiments disclosed herein, one or more of the recesses can have a depth of approximately 0.02 in, or from approximately 0.015 in to approximately 0.03 in or more.

Additionally, in any embodiments disclosed herein, the razor device 200 or any other razor embodiment disclosed and described herein can have magnets, adhesive, or other biasing our coupling elements to bias a razor blade against either the support member 204 and/or against the cover member 240, making it easier for a user to hold a razor blade in the desired position for use or while tightening the cover member 240 relative to the support member 204. For example, two or more magnets 250 can be supported within respective openings or recesses 252 (such as a first recess 252*a* and a second recess 252*b*) formed in the cover member 240. The magnets and recesses can be sized such that, when the magnets are supported within the recesses, the magnets have an outer surface that is either flush or parallel to the first surface 240*a* of the cover member 240 or at least do not extend above the first surface 240*a*, thereby permitting a razor blade to lie flat against the first surface 240*a*.

Alternatively, two or more adhesive strips can be supported within the openings or recesses 252. In any embodiments disclosed herein, the magnets, posts, recesses, and other features described herein can be configured to be positioned on one or both of the support member 204 and the cover member 240. For example, one or more magnets can be positioned on either or both of the support member 204 and the blade cover member 240.

FIGS. 11 and 12 illustrate an embodiment of the blade support member 204. In any embodiments disclosed herein, the blade support member 204 can have a beveled edge 260 (also referred to herein as a bevel element) around all or a portion of the support member 204. As shown, the beveled edge 260 can extend around all or a portion of the tang element or portion of the support member 204 also. The bevel element 260 can improve a user's comfort, grip, and/or control over the blade support member 204 and the angle of the blade support member 204. Additionally, the support member 204 can have a curved depression or contour 262 on either side of the support member 204 configured to receive a user's thumb, forefinger, or otherwise, again to improve comfort, grip, and control over the blade support member 204. Further, a first opening 266 can be formed in the recess 206 to permit a threaded portion 210 of the fastener to extend therethrough, as well as a recess 268 configured to receive a body portion of the fastener 210 to permit a more low profile size and appearance of the razor device 200.

FIGS. 27-34 illustrate an embodiment of the handle member 202. In any embodiments disclosed herein, the handle member 202 can have a first cut out or recess 211 configured to fit partially over or around a head portion of the fastener 210. Additionally, in any embodiments disclosed herein, the handle member 202 can have a second cut out or recess 113 configured to fit partially over or around the protrusion 243 extending away from the blade cover 240.

FIGS. 64-65 and 68-69 illustrate embodiments of a cover member 240 having a ridge 270 along a top edge 240*e* of the cover member 240. The ridge 270 can be used to increase the clamping force on a razor blade by increasing the force applied to a bottom edge 240*f* of the cover member so that an increased force is applied to the razor blade along the bottom edge 240*f* of the cover member. In this manner, the ridge 270 can also help compensate for differing thicknesses of the razor blades, by providing a line or area of contact from the cover member to the razor blade along a bottom edge or bottom edge area of the cover member. The ridge 270 can, therefore, provide leverage to the cover member to increase the clamping force applied to the razor blade. The height and/or thickness of the ridge 270 can be increased or decreased as desired. In the embodiment illustrated in FIG. 68, a height of the ridge (i.e., the distance that it extends away from the planar surface 240*a*, can be approximately 50% greater than a thickness of a razor blade supported within the razor, or from approximately 30% greater than to approximately 75% greater or more than an average thickness of a razor blade supported within the razor. In any embodiments disclosed herein, the ridge can be formed on one or both of the cover member and/or the blade support member.

Figure 71:
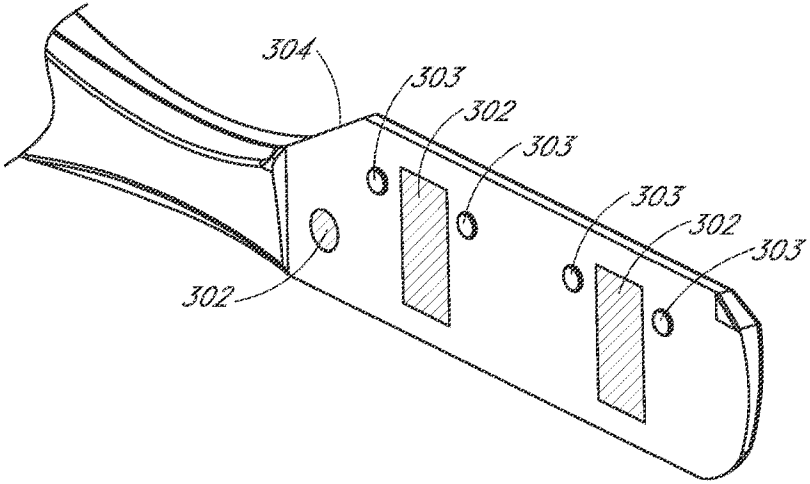
FIG. 71 shows an isometric view another embodiment of a blade support member.
Figure 70:
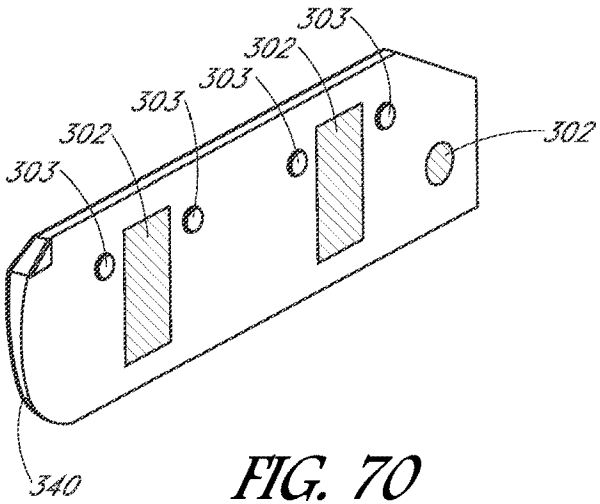
FIG. 70 shows an isometric view of another embodiment of a cover member.

With reference to FIGS. 70-71, any embodiments disclosed herein can have any number of, and size of, magnets 302 and/or protrusions 303 supported by, positioned on, or formed in any of the cover member is or support members disclosed herein. For example, any of the embodiments herein can have rectangular shaped magnets 302 supported within recesses formed within any cover member, such as cover member 340 illustrated in FIG. 70. Similarly, any of the embodiments herein can have rectangular shaped magnets 302 supported within recesses formed within any support member, such as support member 304 illustrated in FIG. 71.

FIGS. 70-76 illustrate another embodiment of a razor 400 that can be used for supporting any of a variety of exchangeable blades. Any embodiments of the razor 300 disclosed herein can have any of the same features, components, sizes, materials, or other details of any of the other razor embodiments disclosed herein, including, without limitation, the razor embodiment 100 and/or razor embodiment 200, in addition to, in the alternative to, and/or in combination with any of the other features described with respect to razor 300 herein. Additionally, any embodiments of the razor 100 or razor 200 disclosed above can have any of the features, components, sizes, materials, or other details of razor embodiment 400 disclosed herein, in addition to, in the alternative to, and/or in combination with any of the other features described with respect to razor 100 and/or razor 200 herein. Razor 400 can have a handle member 402, a support member 404, and a cover member 406. Additionally, a clamp member 408 can be used to removably couple the cover member 406 with the support member 404 after a razor blade 410 has been inserted in the desired position within the razor 400.

Figures 72, 73, 74, 75, 76, 77, 78, 79:
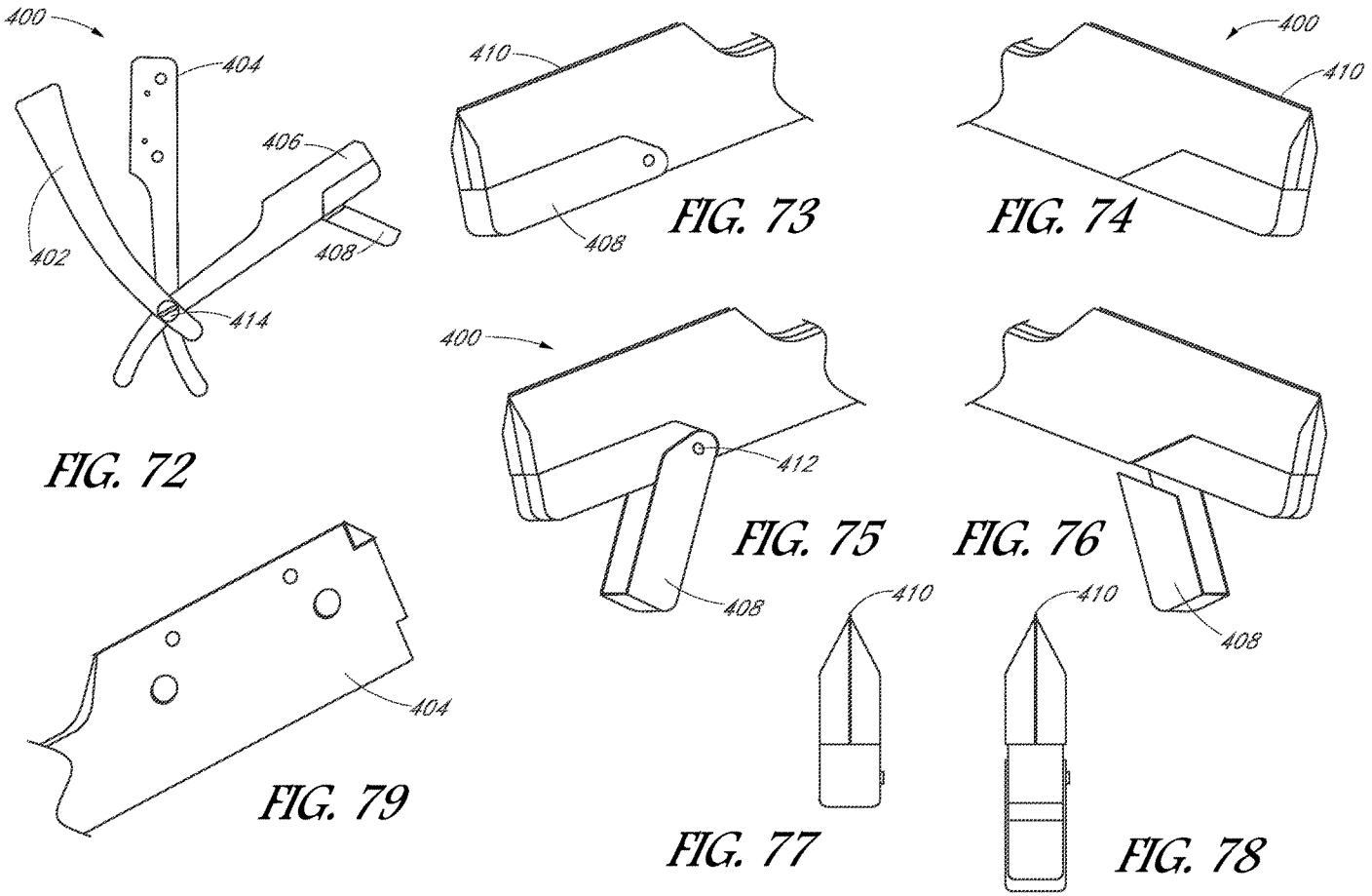
FIG. 72 is a side view of another embodiment of a razor device.
FIG. 73 is a first isometric view of the embodiment of the razor device shown in FIG. 72, with a clamp member in a closed position.
FIG. 74 is a second isometric view of the embodiment of the razor device shown in FIG. 72, with a clamp member in a closed position.
FIG. 75 is a first isometric view of the embodiment of the razor device shown in FIG. 72, with a clamp member in an open position.
FIG. 76 is a second isometric view of the embodiment of the razor device shown in FIG. 72, with a clamp member in an open position.
FIG. 77 is an end view of the embodiment of the razor device shown in FIG. 72, with a clamp member in a closed position.
FIG. 78 is an end view of the embodiment of the razor device shown in FIG. 72, with a clamp member in an open position.
FIG. 79 is a side view of the embodiment of a portion of the razor device shown in FIG. 72.
Figure 80:
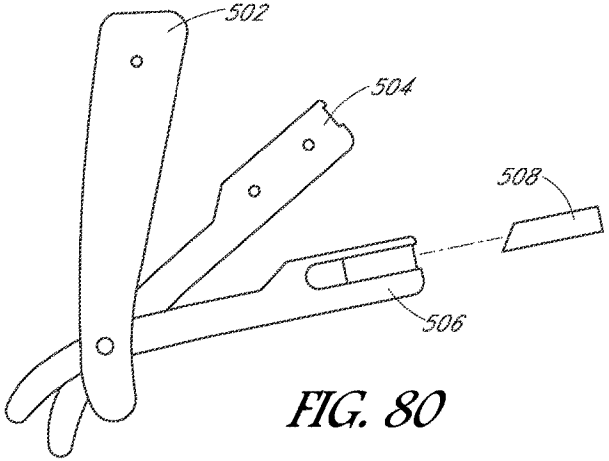
FIG. 80 is a side view of another embodiment of a razor device.
Figure 85:
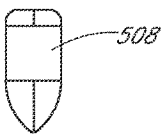
FIG. 85 is an end view of the embodiment of the razor device shown in FIG. 80, with a clamp member coupled with a body portion of the razor device embodiment.
Figure 84:
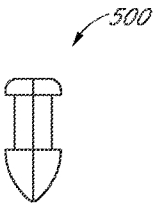
FIG. 84 is an end view of the embodiment of the razor device shown in FIG. 80, with a clamp member removed.
Figure 81:
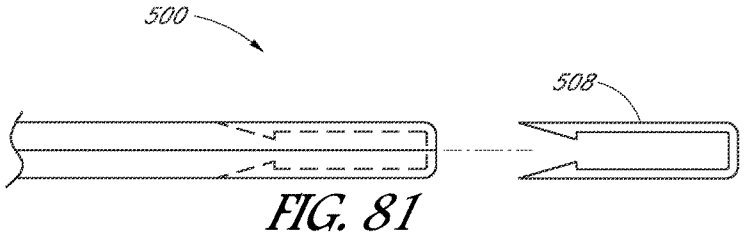
FIG. 81 is a top view of the embodiment of the razor device shown in FIG. 80, with a clamp member removed.
Figure 82:
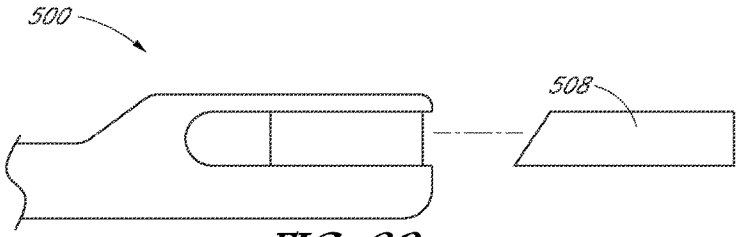
FIG. 82 is a side view of the embodiment of the razor device shown in FIG. 80, with a clamp member removed.
Figure 83:
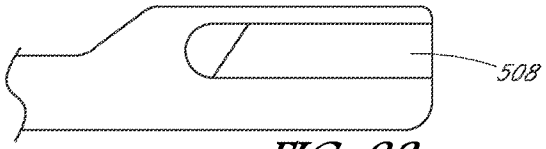
FIG. 83 is a side view of the embodiment of the razor device shown in FIG. 80, with a clamp member coupled with a body portion of the razor device embodiment.

The razor 400 can be configured such that the clamp 408 can rotate about a shaft 4012 supported by the cover member 406. When the clamp member 408 is in an open position, as illustrated in FIG. 73, the cover member 406 can be rotated about the shaft 414 and spread apart from the support member 404, thereby permitting the user to remove the razor blade 410. After new razor blade has been installed, the support member 404 can be rotated back to be within alignment with the cover member 406, and then the client can be rotated to cover the support member 404, as shown in FIG. 71. Additionally, with reference to FIGS. 79-83, any embodiments disclosed herein can have a client member 508 that can clamp over an end portion of both the support member 504 and the cover member 506 to removably secure the cover member 506 to the support member 504.

The overall length of the blade support member in any embodiments disclosed herein can be approximately 5.2 in, or from approximately 4.5 in or less to approximately 5.5 in or more, or from approximately 5.0 in to approximately 5.4 in. In any embodiments, the recess in the blade support member can be approximately 40% of an overall length of the blade support member, or approximately 2.2 in long, or from approximately 2.0 in (or less) to approximately 2.4 in (or more).

In any embodiments disclosed herein, any of the components can be made from steel, aluminum, plastic, composite materials, fiber reinforced materials, or otherwise. For example and without limitation, the body member, cover member, and/or fasteners can be made from steel or any other suitable metal material. The cover member can be made from plastic or aluminum, or any other suitable material.

Any of the embodiments disclosed herein of the assemblies, components, or parts can have any combination of the features, components, or other details of any of the other assemblies, components, or parts disclosed herein or known in the field of shaving devices or other similar apparatuses. Features, materials, characteristics, or groups described in conjunction with a particular aspect, embodiment, or example are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

While certain embodiments have been described, these embodiments have been presented by way of example only, and are not intended to limit the scope of protection. Indeed, the novel methods and systems described herein may be embodied in a variety of other forms. Furthermore, various omissions, substitutions and changes in the form of the methods and systems described herein may be made. Those skilled in the art will appreciate that in some embodiments, the actual steps taken in the processes illustrated and/or disclosed may differ from those shown in the Figures. Depending on the embodiment, certain of the steps described above may be removed, others may be added. Accordingly, the scope of the present disclosure is intended to be defined only by reference to the appended claims. The accompanying claims and their equivalents are intended to cover such forms or modifications as would fall within the scope and spirit of the protection. Furthermore, the features and attributes of the specific embodiments disclosed above may be combined in different ways to form additional embodiments, all of which fall within the scope of the present disclosure. Although the present disclosure provides certain preferred embodiments and applications, other embodiments that are apparent to those of ordinary skill in the art, including embodiments which do not provide all of the features and advantages set forth herein, are also within the scope of this disclosure. Accordingly, the scope of the present disclosure is intended to be defined only by reference to the appended claims or claims that will be added in the future.

Features, materials, characteristics, or groups described in conjunction with a particular aspect, embodiment, or example are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Accordingly, while certain embodiments have been described, these embodiments have been presented by way of example only, and are not intended to limit the scope of protection. Indeed, the novel methods and systems described herein may be embodied in a variety of other forms. Furthermore, various omissions, substitutions and changes in the form of the methods and systems described herein may be made. Those skilled in the art will appreciate that in some embodiments, the actual steps taken in the processes illustrated and/or disclosed may differ from those shown in the Figures. Depending on the embodiment, certain of the steps described above may be removed, others may be added. Furthermore, the features and attributes of the specific embodiments disclosed above may be combined in different ways to form additional embodiments, all of which fall within the scope of the present disclosure.

Although the present disclosure includes certain embodiments, examples and applications, it will be understood by those skilled in the art that the present disclosure extends beyond the specifically disclosed embodiments to other alternative embodiments and/or uses and obvious modifications and equivalents thereof, including embodiments which do not provide all of the features and advantages set forth herein. Accordingly, the scope of the present disclosure is not intended to be limited by the specific disclosures of preferred embodiments herein, and may be defined by claims as presented herein or as presented in the future. Finally, as used herein and unless otherwise stated, the term approximately is meant to represent a range of +/−10% of the stated value.

What is claimed is:

1. A razor device for supporting a razor blade, comprising:

a blade support member having a recess formed therein;

a handle member coupled with the blade support member and rotatable relative to the blade support member;

and a cover member coupleable with the blade support member;

wherein:

the razor blade is removably supportable between the blade support member and the cover member;

the recess is sized such that, when the cover member is operably coupled with the blade support member, a perimeter edge of the cover member is either substantially aligned with a perimeter of the recess or within the perimeter of the recess; and the cover member is coupleable adjacent to the recess.

2. The razor device of claim 1, wherein the cover member has a perimeter shape and size that covers nearly all of the razor blade when the razor blade is in an operable position between the blade support member and the cover member, except a cutting edge of the razor blade which is not covered by the cover member.

3. The razor device of claim 1, wherein the cover member is removably coupleable with the blade support member using a single threaded fastener.

4. The razor device of claim 1, wherein:

the razor device comprises a threaded fastener that removably couples the cover member with the blade support member; and the fastener has a head portion that is rotatable with a single thumb or finger without a use of tools.

5. The razor device of claim 1, comprising a fastener for the cover member that is removably coupleable with the blade support member using a screw type fastener having a head portion that extends partially above a top surface of the cover member such that a user can loosen or tighten the fastener by moving the user's thumb or forefinger against the portion of the head portion of the fastener that extends partially above the top surface of the cover member.

6. The razor device of claim 1, wherein the razor device is configured to support any one of a standard injector razor blade, a Feather razor blade, and a double-edge razor blade.

7. The razor device of claim 1, comprising one or more magnets supported by at least one of the cover member and the blade support member.

8. A razor device for supporting a razor blade, comprising:

a blade support member having a first planar surface defining a blade receiving area, the blade receiving area being defined as the area of the first planar surface against which a razor blade is coupled when the razor blade is in an operable position;

a first projection extending away from the first planar surface of the blade support member in a direction that is generally perpendicular to the first planar surface;

one or more magnets coupled with the blade support member and positioned within the blade receiving area of the blade support member, the one or more magnets configured to attract a razor blade supported by the razor device against the one or more magnets to removably hold the razor blade against the blade support member;

wherein:

the razor blade is removably supportable against the blade support member using the one or more magnets;

the first projection is located outside of the blade receiving area and is located adjacent to a top edge of the blade receiving area such that a top edge of a razor blade supported by the razor device in the blade receiving area will abut against the first projection;

the first projection is configured to limit a translation of a razor blade operably supported by the razor device in at least a first direction along the first planar surface of the blade support member when the razor blade is in contact with the first planar surface; and the first direction is defined as the direction that is approximately perpendicular to a cutting edge of the razor blade that is supported in an operable position against the first planar surface.

9. The razor device of claim 1, comprising a first protrusion and a second protrusion extending away from a first planar surface at least one of the cover member and the blade support member in a direction that is generally perpendicular to the first planar surface of the cover member and/or the blade support member, wherein:

the cover member is configured to support a razor blade against the first planar surface thereof;

the first planar surface of the blade support member is the surface against which a planar surface of the razor blade is positioned when the razor blade is supported by the blade support member in an operable position; and the first and second protrusions are configured to provide a stop surface for at least one of a double-edge razor blade that has been split in half, a standard injector blade, and a Feather injector blade in at least one direction along the first planar surface of the cover member and/or the blade support member.

10. The razor device of claim 1, wherein the blade support member has one or more beveled edges.

11. The razor device of claim 1, comprising two or more depressions formed in the blade support member configured to receive the bent edges of a double-edge razor blade that has been split in half, the two or more depressions extending through a first planar surface of the blade support member, the first planar surface being a surface of the blade support member against which a planar surface of the razor blade is positioned when the razor blade is supported by the blade support member in an operable position.

12. The razor device of claim 1, wherein the blade support member has a curved depression formed therein between a first end of the blade support member and the recess, the curved depression configured to improve a grip and a control of the razor device when the user applies his or her thumb against the depression.

13. The razor device of claim 1, wherein at least one of the blade support member and the cover member has a ridge extending away from a first planar surface of at least one of the blade support member and the cover member along a first edge of at least one of the blade support member and the cover member, the ridge being positioned closer to a back edge of a razor blade that is operably supported by the razor blade support member than to a cutting edge of the razor blade that is operably supported by the razor blade support member, the back edge of the razor blade being opposite to the cutting edge of the razor blade.

14. A razor device for supporting a razor blade, comprising:

a blade support member; and a cover member coupleable with the blade support member, the cover member being rotatable relative to the blade support member between a first position in which the cover member supports the razor blade in a usable position and a second position in which the razor blade is removable from the razor device;

wherein:

the razor is configured to removably support the razor blade between the blade support member and the cover member; and the cover member is rotatable about an axis of rotation located approximately in a middle portion of the cover member.

15. The razor device of claim 14, comprising a recess formed in the blade support member, the recess having a size and a shape that approximately matches a size and a shape of a perimeter of the cover member.

16. The razor device of claim 14, comprising a fastener to removably couple the cover member to the blade member, wherein the fastener is axially aligned with the axis of rotation located in the middle portion of the cover member such that the cover member is rotatable about the fastener.

17. The razor device of claim 14, wherein at least one of the blade support member and the cover member has at least two recesses formed therein, the recesses being sized and positioned to receive curved end portions of a double edge blade that has been broken in half.

18. The razor device of claim 14, comprising a handle member coupleable with the blade support member and rotatable relative to the blade support member.

19. A method of changing a razor blade in a razor, comprising:

loosening a first fastener that advances through a middle portion of a cover member and is coupled with a blade support member without decoupling the first fastener from the blade support member;

rotating the cover member about the first fastener from a first position to a second position relative to the blade support member, wherein, in the first position, the cover member operably supports the razor blade in a usable position and, in the second position, the razor blade is removable from the razor device;

removing the razor blade from razor without decoupling the first fastener from the blade support member and while the cover member remains in the second position relative to the blade support member;

inserting a new razor blade between the cover member and the blade support member while the cover member remains in the second position relative to the blade support member;

rotating the cover member to the first position; and tightening the first fastener.

20. The razor device of claim 1, comprising a protrusion extending away from a first planar surface of the cover member in a direction that is generally perpendicular to the first planar surface, wherein:

the cover member is configured to support the razor blade against the first planar surface;

the first planar surface is a surface of the blade support member against which a planar surface of the razor blade is positioned when the razor blade is supported by the blade support member in an operable position;

the protrusion is configured to provide a limit for the razor blade so that a distance that a cutting edge of the razor blade extends past an edge of the blade support member is approximately the same for each razor blade supported by the razor device; and the razor blade is a double-edge razor blade that has been split in half, a standard injector blade, or a Feather injector blade.

21. The razor device of claim 1, wherein:

the blade support member has a first end;

the cover member has a first end portion that, when the cover member is operably coupled with the blade support member, substantially aligns with the first end of the blade support member;

the cover member has a second end portion that is opposite the first end portion of the cover member; and the second end portion of the cover member has a curved shape.

22. The razor device of claim 21, wherein:

the recess has a first end adjacent to the first end of the blade support member and a second end opposite to the first end;

the second end of the recess has a curved shape that substantially matches the curved shape of the second end portion of the cover member.

23. The razor device of claim 1, comprising a rotatable fastener for selectively coupling the cover member with the blade support member, wherein at least one of the blade support member and the cover member comprises a depression formed therein, and wherein the depression is sized and shaped to receive at least a portion of a head portion of the rotatable fastener.

24. The razor device of claim 1, wherein:

the cover member has a first planar surface;

the cover member is configured to support the razor blade against the first planar surface;

the cover member is movable between a first position and a second position relative to the blade support member;

when the cover member is in the first position, the cover member is substantially aligned with the blade support member such that the first planar surface of the cover member is substantially covered by the blade support member; and when the cover member is in the second position, the cover member is substantially out of alignment with the blade support member such that the first planar surface of the cover member is substantially uncovered by the blade support member.

25. The razor device of claim 14, comprising one or more magnets coupled with at least one of the blade support member and the cover member, the one or more magnets configured to attract a razor blade supported by the razor device against the the one or more magnets to bias the razor blade against the blade support member or the cover member.

26. The razor device of claim 14, wherein the cover member has a first planar surface;

the cover member is configured to support the razor blade against the first planar surface;

when the cover member is in the first position, the cover member is substantially aligned with the blade support member such that the first planar surface of the cover member is substantially covered by the blade support member; and when the cover member is in the second position, the cover member is substantially out of alignment with the blade support member such that only a minority of the first planar surface of the cover member is covered by the blade support member.

27. The razor device of claim 8, further comprising a projection extending away from the first planar surface of the cover member in the direction that is generally perpendicular to the first planar surface, wherein:

the projection limits a translation of the razor blade in a second direction along the first planar surface when the razor blade is in contact with the first planar surface; and the second direction is defined as the direction that is approximately parallel to the cutting edge of the razor blade that is supported in an operable position against the first planar surface and in contact with the first protrusion.

28. The razor device of claim 8, further comprising a handle member coupled with the blade support member and rotatable relative to the blade support member.

29. The razor device of claim 8, comprising a cover member coupleable with the blade support member.

30. The razor device of claim 8, further comprising a second projection extending away from the first planar surface of the blade support member in the direction that is generally perpendicular to the first planar surface, wherein:

the second projection is located outside of the blade receiving area and is located adjacent to a front edge of the blade receiving area, the front edge of the blade receiving area is the edge of the blade receiving area that is closest to a distal end of the blade support member; and the second projection is configured such that a side edge of a razor blade supported by the razor device in the blade receiving area will abut against or be positioned adjacent to the second projection such that the second projection will limit a movement of the razor blade operably supported by the razor device in a lengthwise direction of the razor blade.

31. The razor device of claim 8, further comprising at least two recesses formed in the blade support member, the recesses being sized and positioned to receive curved end portions of a double edge blade that has been broken in half when the double edge blade that has been broken in half is positioned against the blade support member so that the double edge blade that has been broken in half lies flat against the blade support member.

32. The razor device of claim 1, wherein the cover member has a length that is no more than approximately 10% to approximately 20% greater than a length of the longest razor blade supportable by the razor device.

33. The razor device of claim 14, wherein the cover member has a length that is no more than approximately 10% to approximately 20% greater than a length of the longest razor blade supportable by the razor device.

34. The razor device of claim 14, wherein the razor device is configured to support any one of a double-edge razor blade that has been split in half, a standard injector blade, and a Feather injector blade, and wherein at least one of the blade support member and the cover member has one or more projections extending away from a main surface of the blade support member and/or the cover member near an end portion of the blade support member and/or the cover member, the one or more projections being configured to limit a movement of any one of a double-edge razor blade that has been split in half, a standard injector blade, and a Feather injector blade and supported by the razor device in at least a lengthwise direction of the blade.

35. The razor device of claim 14, wherein at least one of the blade support member and the cover member has a lengthwise stop element positioned adjacent to a distal end of the razor device that limits a lengthwise movement of a razor blade supportable by the razor device.

36. The razor device of claim 30, wherein the second projection is located adjacent to the distal end portion of the blade support member.

37. The razor device of claim 8, further comprising a razor blade, wherein the blade is a double-edge razor blade that has been split in half, a standard injector blade, or a Feather injector blade.

* * * * *